US007866910B2

(12) United States Patent
Gustafson et al.

(10) Patent No.: US 7,866,910 B2
(45) Date of Patent: Jan. 11, 2011

(54) COMMUNITY INTERMODAL TRANSIT SYSTEM

(76) Inventors: Thomas F. Gustafson, 15725 Boeing Ct., Wellington, FL (US) 33414; Ramon Trais, 703 Florida Ave., Fort Pierce, FL (US) 34950

( * ) Notice: Subject to any disclaimer, the term of this patent is extended or adjusted under 35 U.S.C. 154(b) by 611 days.

(21) Appl. No.: 11/891,507

(22) Filed: Aug. 10, 2007

(65) Prior Publication Data

US 2008/0038054 A1 Feb. 14, 2008

Related U.S. Application Data

(63) Continuation-in-part of application No. PCT/US2006/004984, filed on Feb. 13, 2006.

(60) Provisional application No. 60/652,201, filed on Feb. 11, 2005.

(51) Int. Cl.
*E01C 1/00* (2006.01)

(52) U.S. Cl. ..... 404/1

(58) Field of Classification Search ..... 404/1
See application file for complete search history.

(56) References Cited

U.S. PATENT DOCUMENTS

| | | | | | |
|---|---|---|---|---|---|
| 671,686 | A * | 4/1901 | Bergeron | 405/132 |
| 1,784,728 | A * | 12/1930 | Harriss | 404/1 |
| 1,830,518 | A * | 11/1931 | Mason | 52/176 |
| 3,675,584 | A * | 7/1972 | Hall | 104/28 |
| 3,847,496 | A * | 11/1974 | Stankiewicz | 404/1 |
| 2006/0272248 | A1 * | 12/2006 | Gustafson | 52/236.3 |

* cited by examiner

*Primary Examiner*—Gary S Hartmann
(74) *Attorney, Agent, or Firm*—Melvin K. Silverman; Yi Li

(57) ABSTRACT

A community intermodal transit system includes a city or town center and low speed mixed-mode corridors extending substantially radially outwardly from said city center. Further included are a corresponding number of circumferentially disposed parking structures located proximally to outer ends of the mixed-mode corridors and an outer transportation network including various modes of transportation, each mode including a transfer point to at least one of said parking structures. Service roads are provided to the city center, as are direct public links from the parking structures to airports or a seaport. Low speed, low profile vehicles may operate on small gauge tracks upon said mixed-mode corridors.

26 Claims, 17 Drawing Sheets

500
510
414
406
300/310
239A
402
217
404
400
265A
408

26
204
410
215
412
220
271
CITY CENTER 260
215
26
271
300/310
300/310
205/215
200
213
276
101/100
215A
265
243
239
203
26
204
219
202
239A
203
217
275
247
239

COMMUNITY INTERMODAL TRANSIT SYSTEM

REFERENCE TO RELATED APPLICATION

This application is a continuation-in-part of International Application Number PCT/US2006/004984, filed Feb. 13, 2006, entitled Community Intermodal Transit System, which claims the priority of U.S. Patent Application Ser. No. 60/652,201, filed Feb. 11, 2005. All parent applications are hereby incorporated by reference in their entirety.

BACKGROUND OF THE INVENTION

Community-based intermodal facilities, as now conceptualized, induce large-scale pedestrian movements based upon the cumulative pedestrian supportive characteristics of the urban habitat features (the pedestrian-orientation thereof that will hereinafter be referenced as "pedestrian-oriented" structures, building facades components, corridors, transit, hardscape, landscape, or other elements of the urban built environment); increase multimodal transportation system usage by use of innovative corridor, parking, and community transit strategies, and other methods to induce large-scale pedestrian intermodal access; and, stimulate economic, and community, and personal development.

Through the use of pedestrian-oriented corridor and community transit strategies, abundant shared-use, parking structures reduce traffic congestion, frame the new pedestrian-oriented urban form, and reduce private developer costs normally associated with parking requirements. Further, such intermodal community development strategies can provide: more affordable housing and business locations; economic growth for diverse business, social and residential populations; and, a variety of enhanced education, health, and quality of life opportunities.

Moreover, by using governmental transportation trust funds and other public infrastructure financing techniques to develop such community-based, pedestrian-oriented intermodal transportation solutions (parking, community transit, and the public places that help to gather passengers in preparation for intermodal transfers) and reserving the use of private investor funds for a variety of mixed-use projects that support economic development, the financial burdens on local governments related to such intermodal improvements are reduced. This method to reduce traffic congestion and promote community development helps to grow the local tax base and enables these community and transportation improvements to be self-supporting.

These recommendations require a paradigm shift. Transportation trust funds and other governmental funds used to build highways must be used to develop a built environment that induce travelers to abandon their nearly exclusive dependence on the single-occupant, private passenger automobile, to use other modes of transportation as part of virtually every automotive trip (making every trip to some degree multimodal) and to productively interact with community residents, visitors, and business, educational, and social institutions in the new pedestrian-oriented urban and suburban centers along major highway corridors and in the redeveloped city and town centers.

A premise of this invention is that world-class mobility and exceptional economic growth can be more readily achieved through the development of seamless multimodal transportation systems, not more road building; therefore a prudent transportation policy would be to use available road building funds to fully develop community-based, pedestrian-oriented intermodal facilities and related community and multimodal improvements. Development of such community intermodal systems ("CIS") as herein described is a method to achieve sustainable world-class mobility and exceptional economic growth by the development of parking and pedestrian linkages between various modes of transport (especially between cars and rail transit), as well as conditions that will tend to improve the natural environment of the intermodal community and the quality of life (i.e., intellectual growth, emotional well-being, physical health and capabilities) of the residents and frequent visitors to such intermodal communities.

Transportation systems and community development in the best of circumstances should represent the two sides of the same coin. The community should provide for every need of each citizen and visitor and the transportation system should provide high quality citizen and visitor access to those needs.

In the last fifty years, there has been a growing incompatibility between the requirements of an automotive-based transportation system and the urban community capacity to satisfy citizen and visitor needs. Traffic congestion, air and water quality degradation, pedestrian and automotive fatalities, slum and blight are but a few of the community problems that have surfaced as road networks expand and lengthen to satisfy mobility demands.

Fortunately, transportation policy initiatives to support intermodal improvements may provide a basis for mutually beneficial community and transportation system enhancements. Like modern airport terminals, these intermodal improvements should respond to both the need to park automobiles near opportunities to board alternative transport modes and provide for an environment where basic human needs are satisfied (places to eat, read, talk and sit) until the next segment of a multimodal trip begins.

Like the best of communities, these needs should be provided not only within the built environments, but also, in the out-of-doors public spaces dispersed throughout the community and urban centers. These areas must be protected from the harshness and discomfort of the natural elements, e.g., too cold, too hot, too wet or humid, too bright or too dark by the structural components of the built environment and therefore are functionally defined as the habitable and desirable places in the spaces between building. Within these public places, the distances actually walked should be mitigated and flexible to provide exercise, but not exhaustion. On the other hand, the dimensions of these urban and suburban centers need to be large enough to accommodate the significant and varied development that support large-scale pedestrian movements and multimodal access and usage.

This invention presents a fundamentally new way of assembling the building blocks of an intermodal transportation system into sustainable high-quality communities that provides a basis for world-class economic growth throughout a wide diversity of the citizenry.

To understand the premises upon which the invention is based, it is necessary to focus on both the macro-transportation systems and human-scale community issues that are required for the development of creative, successful, and historically inspired communities. Broadly speaking, transportation systems in America are large capital investments that must accommodate large numbers of private passenger automobiles and, in the case of transportation systems using aircraft, transit or waterborne vessels, large numbers of parked cars and pedestrian movements from parked cars to and within intermodal terminal facilities.

In most developed and rapidly developing nations, everyone wants to drive to their destination. In doing so, however, some very bad things can happen. In America, hundreds of thousands of people suffer sudden accidental death on congested highways (see: *Mean Streets* 2004 at: http://www.transact.org/library/reports_html/ms2004/pdf/Final_Mean_Streets__2004__4.pdf); millions of people suffer with chronic illnesses due to stress, air pollution, and lack of physical exercise (see: *Suburban Sprawl and Physical and Mental Health* at: http://www.ncbi.nlm.nih.gov/entrez/query. fcqi? cmd= Retrieve& db= Pub Med& list_uids= 15351221& dopt=Citation); and, the social behavior amongst Americans looks less fraternal, and more aggressively adverse, with each passing year (see: *Fast Facts from Texas Department of Public Safety, Road Rage* at: http://www.txdps.state.tx.us/director_staff/public_information/Fast_facts/roadrage.pdf; *Road Rage Becoming Commonplace: Survey* at: http://autonet.ca/Safety/story.cfm?story=/Safety/2004/11/15/715913.html; and Federal Motor Carrier Safety Administration Road Rage Survey reference at: http://www.fmcsa.dot.gov/about/outreach/dsweek/survey.htm). Many similar sources and observations can be referenced for other car-dominated urban communities around the world and it is expected that such road rage behavior will become more recognized in all car-dominated communities absent the use of the present invention in those world communities.

What should be readily understood is that the travel needs of a speeding automobile (wide, smooth asphalt or concrete surfaces) are exactly the opposite of the safe, comfortable, useful and interesting environments that humans respond to favorably. In short, the natural and best environment for the automobile is inherently a risk and hazard to humans who are not enclosed within the protective cocoon of their own automobile, otherwise separated from the automotive traffic. Conversely, the typical human habitats, i.e., your living room, bedroom and office are not suitable for the operation of an automobile at typical design speeds, e.g., 30 to 60 miles per hour or more.

Modern architecture and community designs, however, assume the automobile is welcome everywhere. It is precisely this lack of awareness that moving cars and people don't mix very well, that causes most of the design flaws of our built environment. Flaws that adversely impact all components of our communities and that will hopefully be rectified by the methods described below.

This does not mean that cars should not be used for many or even most of the trips between the urban, suburban and rural environments. Nor does it mean that car trips are no longer enjoyable and rewarding in very specific car-friendly circumstances: non-congested traffic conditions; interesting views of the natural and built environments that can be observed from a moving vehicle; the comfort of lounge-like seating during air-conditioned, smooth, and uninterrupted car trips; and, the entertainment, food and beverages that can be consumed during such car trips.

As one of the world's major industry, automotive-based transportation systems represent billions of dollars of investments in the movement, care, and feeding of the car-driving public. Such automotive related investments, however, can not be used as intended and do not provide the benefits envisioned when chronic car traffic congestion destroys productivity and mobility, fouls the air we breath, degrades the esthetics and physically conditions of the natural environment, and helps to support the sedentary lifestyle and obesity epidemic evident in America and other developed nations of the world.

What this does mean, however, is that as more and more of our streets and communities become congested with traffic, continued car use in those congested areas is not cost effective or beneficial and alternative modes of transportation must be successfully encouraged. In traffic congested communities, the air quality endangers health and urban blight threatens safety and the community esthetics, not to mention the economic vitality of the urban and suburban centers. This also means phase-out of car dominated systems of movements from home-to-work-to-home and to social events and the events of daily life in order to:

- reinforce a non-sedentary lifestyle;
- increase walking, running, and other exercise that is anatomically appropriate for the healthy human condition and that would not typically occur with the continuous availability of car movements; and,
- reduce public health risks due to obesity, traffic injuries and deaths, and diminished air quality.

When traffic congestion is a dominant factor of daily life, the allurement and efficiencies of automotive movements are diminished due to substantial loss of work and leisure time, a reducing of quality of life, and increasingly dangerous driving conditions and, within a very short time period (a decade or so), the community benefits of car movements can vanish.

In virtually all growing urban and suburban communities, a time comes when more road building no longer is a cost effective means to reduce traffic congestion. Limited right-of-way opportunities in already developed areas, very high costs for right-of-way acquisitions in urban and suburban areas, and significant business losses associated with the right-of-way acquired for road expansion projects, collectively constrain the physical, financial, and public support conditions necessary for recurring road building options. Not withstanding diminished road building efforts, development continues and traffic congestion exacerbates.

When road networks are build outward from the urban and suburban center in more rural communities to avoid such road building and right-of-way constraints, traffic congestion worsens as more cars driving longer distances, traffic conditions leave fewer places to safely walk from one necessary destination to another, and car movements become the only real option notwithstanding the chronic traffic congestion, loss of mobility, and other adverse, but related, effects to health, the economy, and the environment.

What it does mean is that continued road building is a counter productive and self-defeating mobility strategy that creates adverse conditions that community intermodal system development can remedy. By development of intermodally enhanced, pedestrian-oriented urban communities with very significant and convenient, but mostly invisible, parking capacity, this expansion of the roadway transportation system (highways and the intermodally linked mixed-use pedestrian-oriented parking structures) will accommodate more car traffic by diverting large numbers of cars from the highways and local streets into mixed-use, pedestrian-oriented parking structures and thereafter inducing the car occupants to leave their cars behind as they complete their daily trips using a variety of modal options (walking, bicycles, transit, airplanes and water-borne vessels).

When such community-based intermodal facilities are provided within the urban and suburban built environments, we would keep driving our cars, but when the traffic congestion occurs, we would park, walk, and use transit to regain mobility, reducing energy demands, improving health, air quality, and the economic conditions for each resident and visitor to such pedestrian-oriented, parking enriched, and intermodal enhanced city and town centers In any monolithic system, fundamental design flaws can lead to systems failures with catastrophic consequences. While car only (or car dominated) movements within the urban and suburban communities and transportation systems, puts all residents and visitors at risk, a multimodal transportation system, with efficient and robust pedestrian-oriented intermodal improvements, will make the entire community safe, secure, sustainable and economically successful.

The question that needs to be responded to is specifically what type of intermodal improvements to the transportation system would be good for both the car-driving public in the frequently driven to cities and towns and still support the larger community interests. Further, it must be determined how to reorganize the urban and suburban centers to covert the build and natural environmental conditions from traffic congested, dangerous, unhealthy, unsightly and poor ("slum and blight conditions") into the sustainable, high quality communities that represent the economic engines of a great nation.

SUMMARY OF THE INVENTION

A community intermodal transit system includes a city or town center; a plurality of low speed mixed-mode corridors extending substantially radially outwardly from said city center; a corresponding number of circumferentially disposed parking structures located proximally to outer ends of the mixed-mode corridors; and an outer transportation network including various modes of transportation, each mode including a transfer point to at least one of said parking structures. Service roads are provided to the city or town center, as are direct public links from the parking structures to airports and a seaport. Low speed, low profile vehicles may operate on small gauge tracks upon said corridors.

More specifically, the defining characteristics of a CIS include:

- car-free or nearly car-free city or town center for all or part of the day, week, or month;
- semi-enclosed pedestrian, mixed-mode corridors, courtyards and plazas within the city of town center that provide for use of pedestrians, bicycles, and low speed community or other pedestrian-compatible transit;
- special structural parking (with mixed-use liner buildings);
- community transit within a car-free center operating on mixed-mode corridors to and from the parking structures and extended outwardly there from for up to five miles or so on ergonomic hybrid transit access corridors to link with other regionally significant destinations and transportation modes;
- limited access roadway ramps to provide direct access from highway to the CIS parking structures;
- elevated and below grade traffic aisles between parking structures; and
- traffic-calmed streets to provide automotive access to the parking structures to and from adjacent or nearby community neighborhoods highways or a beltway.

It is an object of the invention to rehabilitate urban communities from slum and blight conditions into centers for economic and human development. To do so, one must accept the premise that cars moving faster than 15 miles per hour should not be mixed with humans unprotected by a similar vehicle, structured barrier or significant distance and that the best human habitats do not have any cars in sight, i.e. quiet restaurant with family and friends, inside any major league baseball park, at a neighborhood swimming pool. Secondly, one must determine how to manage the thousands of cars a day that arrive at our urban and suburban centers so that they can bring, along with the other modes of transportation, the people and goods necessary for the economic, governmental, religious, educational, entertainment, nutritional, health care and cultural activities of a complex and sustainable communities. Thirdly, the city and town centers need to preserve most of their public spaces for people to enjoy without adverse traffic impacts.

Given these apparently conflicting requirements, it is another object to offer an alternative to car-based or car-dominant transportation systems and the chronic traffic congestion and socioeconomic problems they have created for urban planners.

It is not an object to induce people to give up their automobiles for the greater good. Rather, it is proposed rather that if one wants a sustainable, economically vibrant and world-class community where citizens interact in healthy, safe, and socially beneficial ways, one must eliminate car traffic within urban and suburban centers.

It is an object to find better ways to link cars and their parking spaces with opportunities for large-scale pedestrian movements and many other transportation modes, i.e., high speed rail, interregional and regional rail, statewide intercity rail, commuter rail, regional and community transit [narrow gauge rail systems and/or small buses, vans, and community adapted rubber tire vehicles, airplanes and other aircraft, ships, barges, ferries, water taxis, water buses, and other water-borne vessels, bicycles, pedestrian movements.

It is therefore further objects of the instant CIS improvements, and their urban centers as taught herein, to:

- Hide automotives from sight by parking them in structures that are hidden within mixed-use structures (residential, commercial and retail uses);
- Position such mixed-use parking structures and other buildings components of the intermodal community to form high-quality corridors and public spaces supporting large-scale pedestrian movements and community transit;
- Direct truck movements to shared-use freight loading docks or schedule deliveries other then during the times when large-scale pedestrian movements occur; and,
- Configure the built environment to facilitate large-scale pedestrian-based intermodal transfers amongst multiple modes of transportation.

The above and yet other objects and advantages of the present invention will become apparent in the hereinafter Brief Description of the Drawings, Detailed Description of the Invention, and Claims appended herewith.

DETAILED DESCRIPTION OF THE INVENTION

Figure 1:
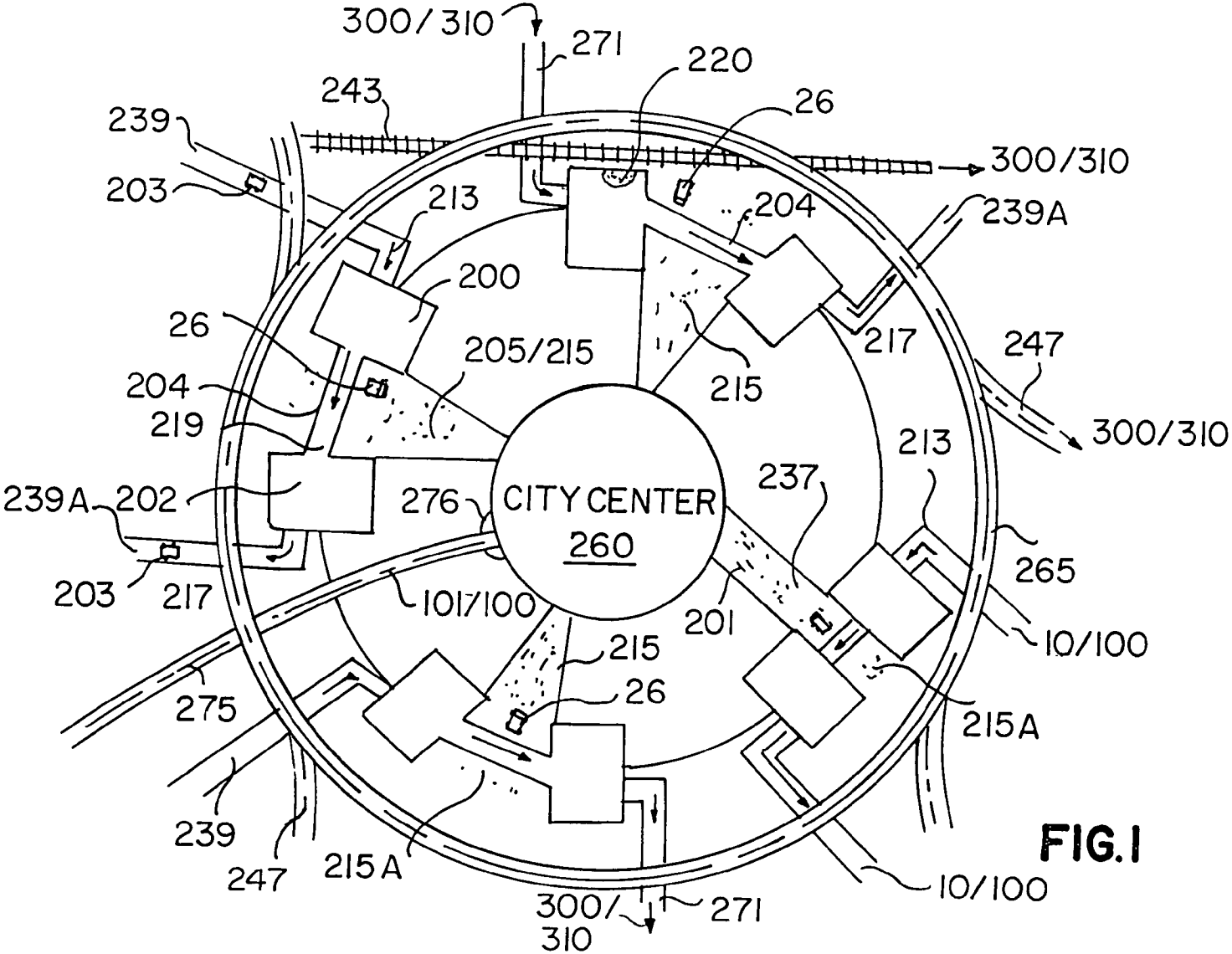
FIG. 1 is a conceptual view of a CIS.

A community intermodal system (CIS) proposes a method of movement that relies upon, within an urban or suburban community context, high quality public spaces between buildings that are safe, comfortable, useful, and interesting. The interaction of each and every component of the urban form should be constructed and positioned to support large-scale pedestrian movements and to further the principal CIS objective: to cause larger than typical numbers of people to walk longer than typical distances and access transit or other modes of transportation as part of a multimodal trip involving at least one car-based trip segment.

While there have been numerous studies to support the calculation that pedestrian movements are typically limited to one-quarter to one-half mile distances (see: *Walking Distances to and from Light-Rail Stations* at: http://www.enhancements.org/trb/1538-003.pdf), little research or observations have been undertaken or published on the numbers of pedestrians that will occupy public space based upon the specific affects on human behavior that can be caused by the physical characteristics and architectural features (see: *Projects for Public Spaces* at: http://www.pps.org/info/aboutpps/). Nor has the environmental conditions that maximize predictable pedestrian movements (lengthen trips and increase numbers of people walking) been well documented.

What CIS improvements provide are new and unique urban forms, inclusive of a specific kind of public space, that will draw into an urbanized area large numbers of automotive travelers (10,000 to 30,000 people assuming 10,000 parking spaces), produce large-scale pedestrian movements (80,000 to 215,000 pedestrian trip segments per square mile per day or more) and cause substantial shifts from automotive to multimodal trips (30 percent or more). Once built, such an intermodal community or urban center would provide a test bed to verify the methods to induce large-scale pedestrian movements and the relationship between such large-scale pedestrian movements, the pedestrian holding capacity or pedestrian-oriented corridors, courtyards, and plazas and highly utilized multimodal transportation systems. A conceptual view of a CIS is shown in FIG. 1.

The components of the CIS and the position of each component relative to other CIS components are constructed to effectuate CIS objectives in multiple ways. Each component and positioning of the component refines the qualities of public space to produce predictable human behaviors within this urban form that favor larger numbers of multimodal movements via: high speed rail; interregional and regional rail; statewide intercity rail; commuter rail; regional and community transit; narrow gauge rail systems; small buses, vans, and other community adapted rubber tire vehicles; airplanes and other aircraft; water-borne vessels, ships, barges, ferries, water taxis, water buses; bicycles; pedestrian movements; and, other modes. Large-scale pedestrian movements (walking distances of one or more miles in concert with community transit by many thousands of people) and substantial modal shifts arise as predictable human behavior within this urban form.

Figure 12:
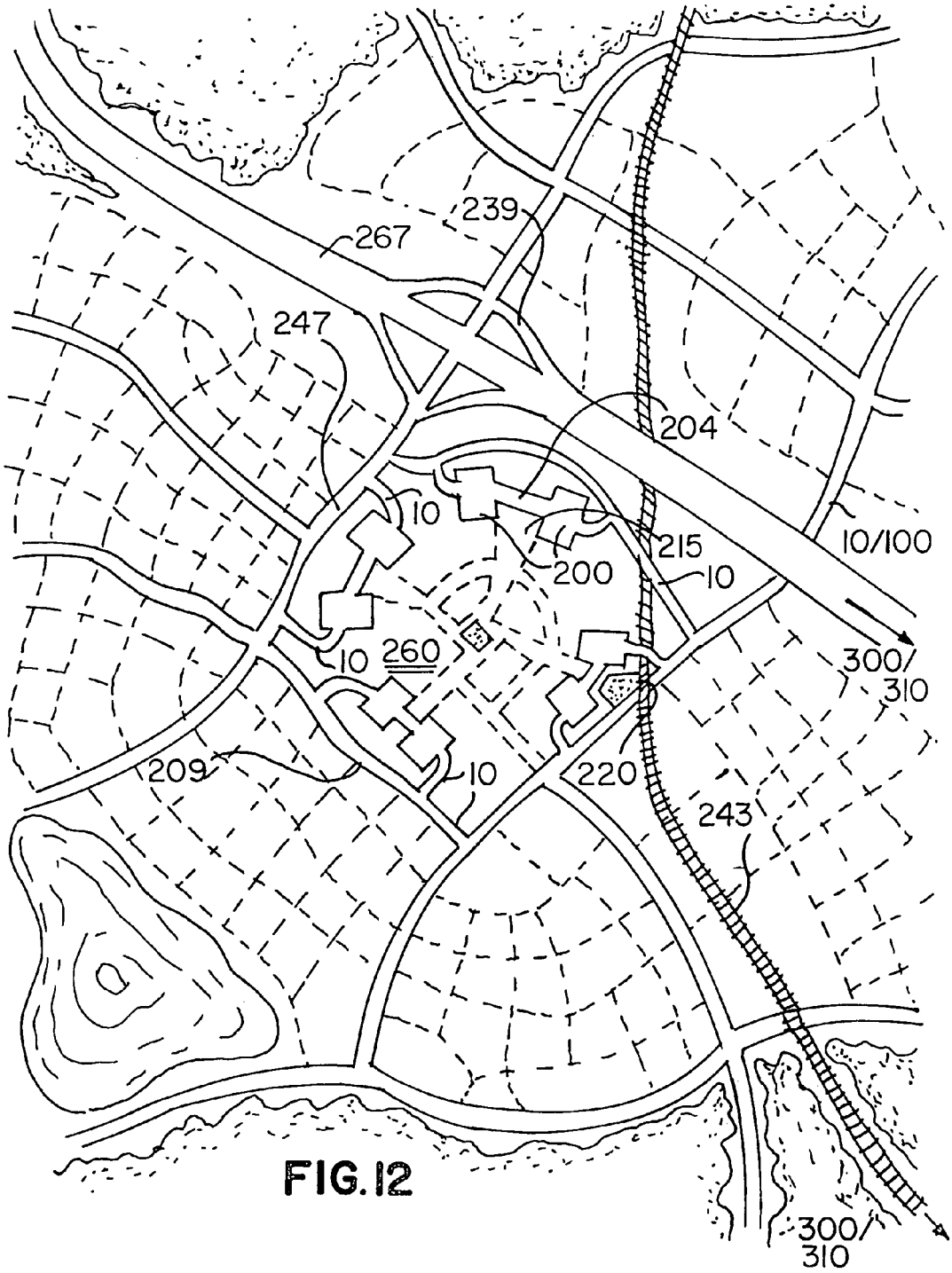
FIG. 12-13 are views of an intermodal community including a rail corridor, a limited access highway, and other adjacent communities.

As may be noted in FIG. 1 and FIG. 12, the principal elements of the CIS therefore include a city or town center 260 including the ergonomic hybrid transit access corridor particularly for town and urban centers as taught in my U.S. Pat. No. 6,561,727 B1 (2003), circumferentially disposed parking structures 200 and 202 of the type set forth in my PCT Application No. PCT/US03/039804 entitled Mixed-Use Pedestrian-Oriented Parking Structure, low speed mixed-mode pedestrian corridors 215 (more fully described below), which include an outermost region 215A, that connects parking structures 200/202 to city or town center 260, feeder highways 247 that may include a limited access or other highway beltway 265, parking structure entry and exit highways 239 and 239A respectively, limited access highways 271 linked to an airport 300 or 500 or seaport 310 or 400, a high speed or other rail link 243 linked to said airport and/or seaport, and traffic-calmed delivery or service roads 275 which approach the mixed-use pedestrian-oriented parking structures 200/202 and city or town 260, preferably as an ergonomic hybrid transit access corridor 10/100 particularly for town and urban centers, including that in my U.S. Pat. No. 6,561,727 B1 (2003). As may be noted, service road 275 ends at roundabout 276. Also shown in FIG. 1 are parking structure entry ramp or entrance 213, elevated cross-over corridor 204 and parking exit 217. Further shown are bicyclists 201, autos 203, pedestrians 205, and low speed community transit vehicles 26 on mixed mode corridors 215.

Further shown in FIGS. 1 and 12 is transfer point 220 for rail link 243, said parking entry ramp 213 as associated with highway 239, said parking exit 217 as associated with highway 239A, and interstate highway CIS transfer point 263 for interstate highway 267.

CIS improvements are constructed using three-story to eight-story mixed-use buildings 40, 40*a* and 40*b* (see FIGS. 6-9) that create spaces functionally related to the human needs of the resident and visiting human population during daily pedestrian or pedestrian-based multimodal trips from private dwelling places to formalized business, educational, entertainment, health and governmental settings, i.e., places to shop, to informally socialize and discuss community issues, to prepare for work or school.

Public spaces between buildings 40 are framed by the exterior of and entrances or other opening to a series of mixed-use buildings that line the perimeter of parking structures. Such liner buildings 210/212 are positioned along wide sidewalks, pedestrian corridors 262, courtyards 264 and plazas 266, walkable and traffic-calmed streets 209 (see: *Walkable Communities* at: http://www.walkable.org/index.htm and the history and type of measures that describe *Traffic Calming* at http://www.trafficcalming.org/), and mixed-mode corridors (see: John Zacharias, "*The Amsterdam experiment* in mixing pedestrians, trams and bicycles" ITE Journal, vol. 69, no. 8, pages 22-28, August 1999 available at http://www.ite.org/itejournal/index.asp.) designed to accommodate a mix of pedestrian, bicycle and transit movements.

Specific structural components of liner buildings 210/212 (see FIGS. 2-4) and corridors 262 provide continuous open-air shelters, i.e., balconies, arcades 241, awnings, roof overhangs, tree and other canopies, covered entry features, courtyards and zaquanes, that protect pedestrians from the sun, rain, wind, heal and cold. This urban environment projects a high quality condition that encourages active human lifestyles and related large-scale pedestrian movements. See

*Pattern, Language* at http://www.patternlanguage.com and *Nature of Order* at: http://www.math.utsa.edu/~salingar/NatureofOrder.html).

Most parking is accommodated in specially designed parking structures having entrances 213 that are circumscribed by said liner buildings 210/212. Within the parking structures 200/202 (see FIGS. 2-3), angled parking spaces 226 are positioned around a central elongated air/light atrium 228 and parallel parking spaces 227 are positioned along the outer edge of the parking structure immediately adjacent the liner building doorways and hallways. The parking spaces are positioned to facilitate one-directional aisles (12 to 18 feet wide) and to be proximate to liner building businesses and residences within the mixed-use liner building component and the destinations along the adjacent mixed-mode corridors and traffic-calmed streets. Intermittent on-street parallel parking spaces provide limited spaces for short term parking opportunities (eight or so spaces per city block).

No or very limited surface parking lots (consisting of six or less parking spaces). More particularly, as may be noted with reference to FIGS. 2-4, parking deck 216 within first liner building 210 provides for parallel parking 227 at the perimeter thereof, this interrupted as necessary by pedestrian corridors 262 (see FIG. 4), pedestrian bridges 208, and entrance platforms 211 to provide a place for pedestrian access by residents, guests, business employees, and their clients and by roadways, and preferably configured as an ergonomic hybrid transit access corridor particularly for town and urban centers as is taught in my U.S. Pat. No. 6,561,727 B1 (2003), vehicular cross-over 204, and one-directional traffic aisles 207 for delivery services to access back doors 240 located at a perimeter wall 224 which comprises an interface between parking portion 216 and first liner building 210. Further, angled parking 226 surrounds said atrium 228 at the center of portion 216 of first parking structure 200.

Figure 2:
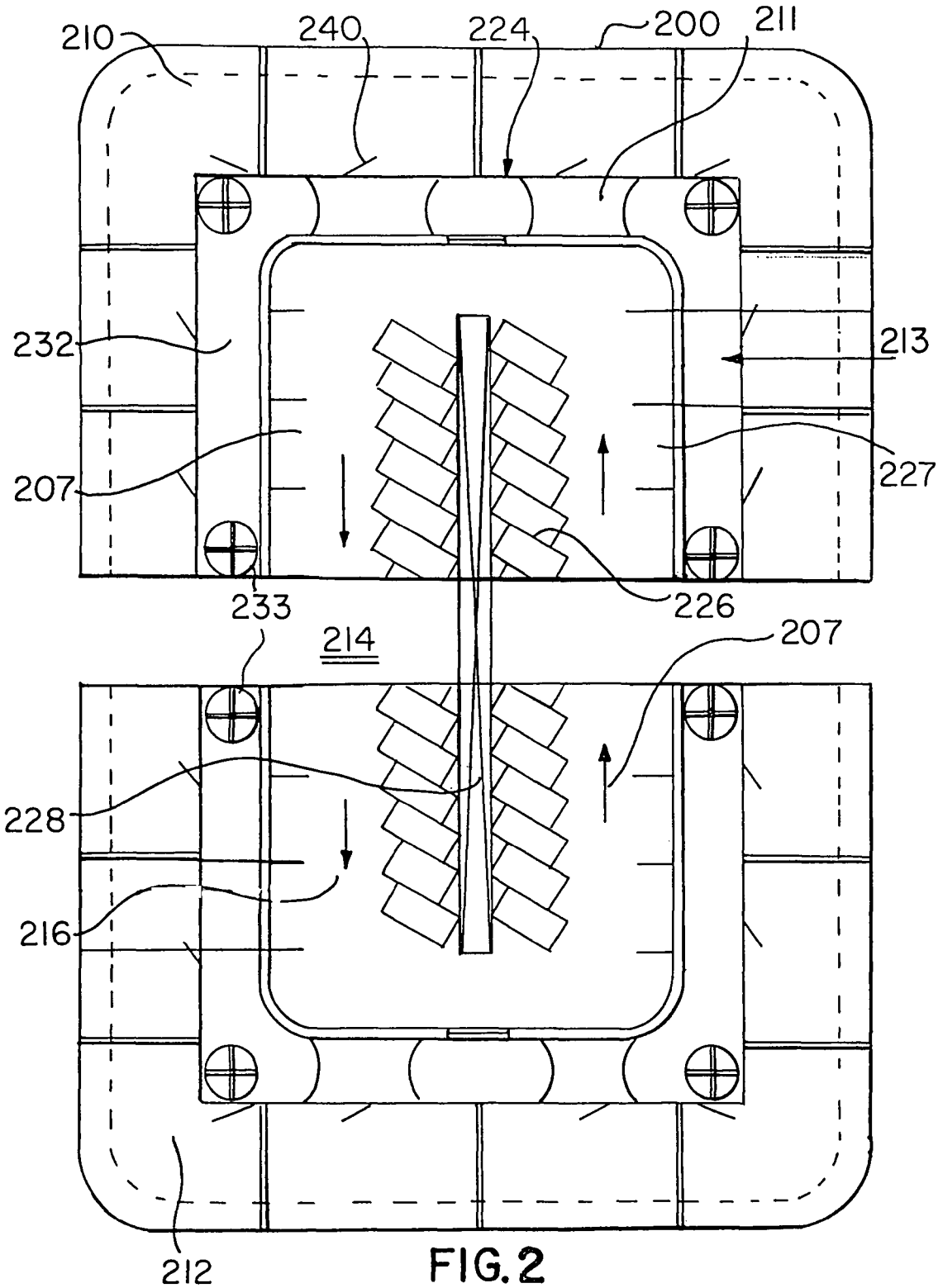
FIGS. 2-4 are schematic view of a mixed-use pedestrian-oriented parking garage structure of the type that surrounds the city or town center.

As may be noted in the embodiment of FIG. 2, direction of travel within the garage is one way (see arrows 207) and allows for sufficient width (12 to 18 feet wide) and height (in a range of 14 to 18 feet high) for automobiles and delivery trucks. Incorporated into the structure may be a central service or loading docks 230 provided at a ground floor (see FIGS. 2-4). There is shown, outwardly of the first liner building 210, a second liner building 212 (see FIG. 3), arcades 241 and awnings, balconies, and roof overhangs which peripherally surround said liner buildings 210/212.

Figure 3:
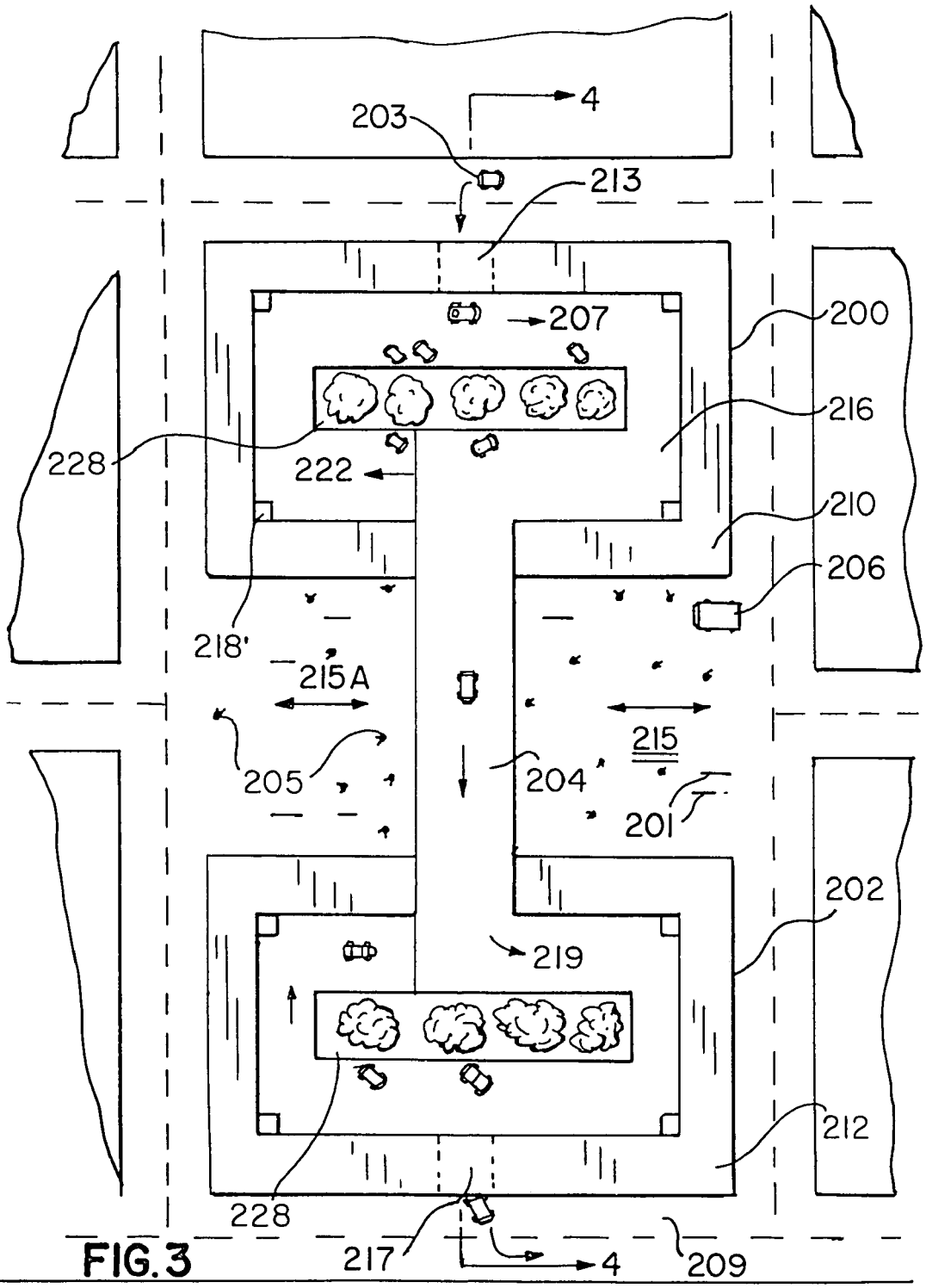

Further shown in FIG. 2 are a buffer corridor 232 into which HVAC and other environmental facilities 233 may be placed. With further reference to FIG. 3, the mixed-mode corridor 215 is preferably a ground level pedestrian-oriented corridor situated between the mixed-use pedestrian-oriented parking structure parts 200 and 202 that can accommodate pedestrians 205, bicyclists 201 and community transit vehicles 26.

Shown at FIG. 3 is the relationship between garage entry 213 of the embodiment of FIG. 2 and garage exit 217, this inclusive of said vehicular cross-over 204 which connects the respective portions of the garage. The system thereof is shown in vertical axial cross-sectional view in FIG. 4 in which pedestrian bridge 208 and pedestrian corridor 262 may also be seen.

Figure 4:
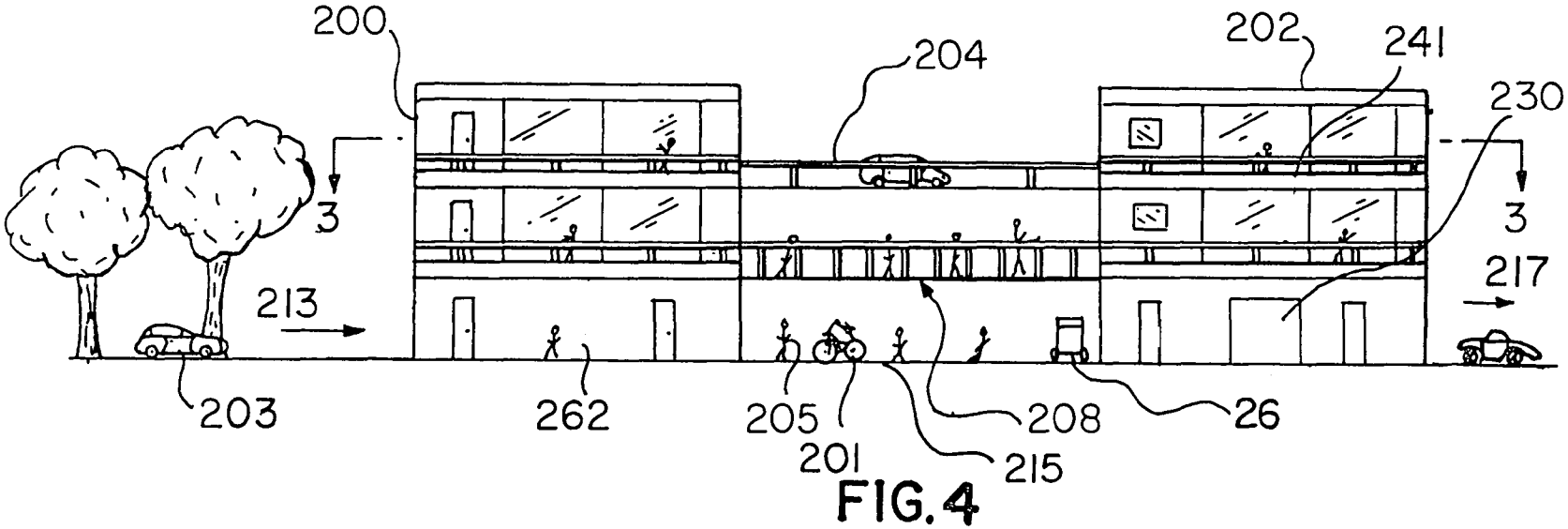

With reference to FIGS. 3-4, the resultant parking structure promotes pedestrian activity by providing a rear or back door access 240 to an adjoining liner building 210 and further provides interior pedestrian access corridors 214, arcades 241 (see FIG. 4) and similar structures that protect pedestrians from the adverse weather conditions, covered street crossing (beneath structures that span the street between city blocks such as mixed-use cross-over 208) or mixed mode corridors 215, traffic calmed streets (see FIGS. 5-9), as is taught in my U.S. Pat. No. 6,561,727 (2003), and mixed-use crossovers 208 and pedestrian corridors 262 to provide pedestrian access between and through the components of the mixed-use, pedestrian-oriented parking structure.

Said parking structure is designed to absorb traffic by efficiently converting automotive trips into pedestrian movements that eliminate traffic congestion and improve intermodel pedestrian access to transit and other transportation modes and to frame public squares and pedestrian or mixed-mode corridors and streets with horizontal components, as discussed in the Ergonomic Hybrid Transit Access Corridor Particularly for Town and Urban Centers of said U.S. Pat. No. 6,561,727 B1 (2003) 245. Within these public spaces (plazas, courtyards, and corridors), small transit, parking shuttle and local circulating vehicles help to more efficiently link parking facilities to destinations within a one to four square mile area and with the mixed-use, pedestrian-oriented parking structure, collectively, constitute a pedestrian-oriented design and transit access system that will improve intermodel movements within the urban community.

The above defines a better method to park automobiles within the shroud of a 20 foot to 90 foot deep liner building (typically 60 feet or so deep) and to incorporate elements of interior design to produce a mixed-use, pedestrian-oriented parking structure that positions parking spaces to better provide access, air, light and security to customers, visitors and residents of mixed-use liner buildings.

Further shown in FIGS. 2-3 is a one-directional driving corridor or parking access isle 207 (see arrows of FIG. 3) to thereby provide an opportunity to build a matched pair or more of parking structures with a third floor vehicular cross-over 204 (see FIG. 4) to structurally integrate with a second floor mixed-use crossover 208 for retail, restaurant or mixed-use activities and to provide cover for mid-block, at grade pedestrian crossings and mixed-mode corridors 215 (see FIG. 4). The narrow width (approximately 90-115 feet) allows for structural columns 218 to be moved to the perimeter of the parking structure or within said air/light well or atrium 228 to thereby avoid shadowing within the parking structure and improve user safety. The narrow characteristic of such structure also makes for an easier application of use of the liner building, given the space needs of retail, office and other commercial or residential uses and the typical dimensions of a city block.

Figure 11:
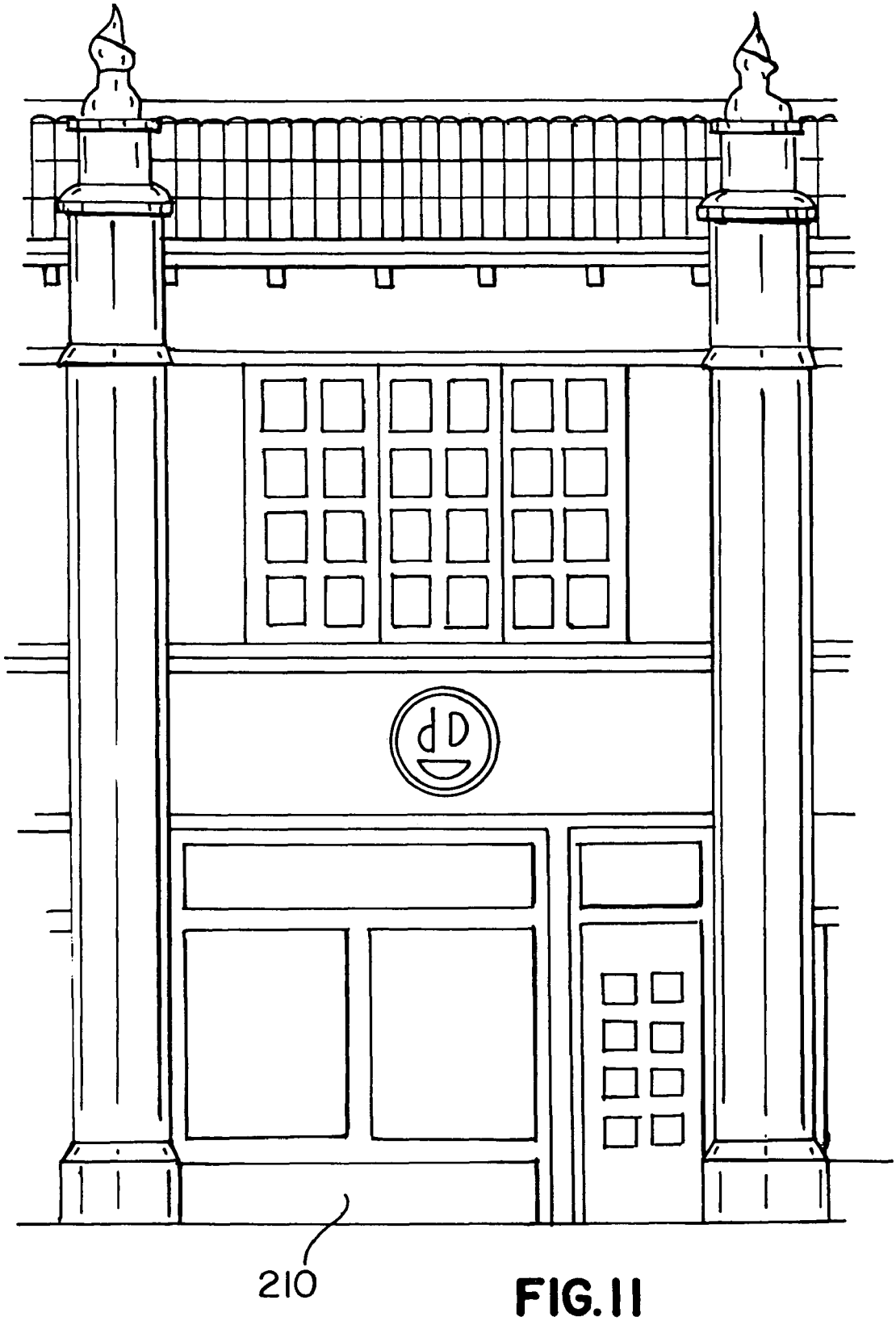
FIG. 11 is a view of a liner building typical section of a parking structure.

Liner building sections (see FIG. 11 as one example) can be developed through contracts with a single developer (using varied architectural firms to design the sequence of distinctive and varied 10 to 30 to 50 feet long building façade sections that face the pedestrian-oriented corridors) or through incremental development of small, separate out-parcels (different owners, architects and builders developing the distinct and varied liner building sections as multiple individual buildings within and approximating the 60 feet deep by 10 to 30 to 50 feet wide lot dimensions with no or minimal side yards) that surround the parking structure and functionally connect the parking spaces with the pedestrian-oriented corridors, plazas and community transit services.

The specific building heights need to provide sufficient light and air to the public realm to respond to all urban health and the multiple environmental needs of the lushly vegetated public places e.g., human and compatible animal and plant life. All components of these three dimensional spaces should appeal to the five human senses (what we see, hear, smell, taste, and feel) and should constitute the urban form of a "green corridor" that provides a sustainable environment for a variety of urban adapted wildlife and urban compatible domestic animals. Because a continuous array of buildings at or above 85 feet in height can create environmental problems within the corridor, courtyard, plaza, pedestrian via, zaquan and other microclimates, buildings sized down to three-story heights or occasional buildings above eight-story heights for specific large scale uses should be placed within the urban form where they add to and do not detract from these CIS objectives (see: *Microclimate and Downtown Open Space Activity* available through; http://eab.sagepub.com/cgi/content/abstract/33/2/296).

Within this pedestrian-oriented environment, large numbers of people walk longer than typical distances because they enjoy the experience. Architectural features vary every 10 to 30 to 50 feet based upon different uses and independently conceived architectural designs that are observable from the public realm at close (30 feet or less), intermediate (30 feet to 300 feet or so) and greater distances (300 feet or more). These features must provide not only visual interest, but also provide other sensory reinforcement opportunities (what one hears, smells, feels, and tastes).

In the traffic calmed streets (see FIGS. 13-14) of the type of the Ergonomic Hybrid Transit Access Corridor Particularly for Town and Urban Centers as is taught in U.S. Pat. No. 6,561,727 B1, there are delivery and service roads 275, and elevated ramps from the limited access highways 271, positioned to link the cars and trucks from the limited access and feeder other highways 267 and 247 respectively with the mixed-use pedestrian-oriented parking structure 200/202, the pedestrian corridors 262, mixed-mode corridors 215, courtyards 264, and plazas 266 to connect the car and truck occupants (when they become pedestrians, bicyclists, and community transit users) with the city or town center 260.

With reference to the views of FIGS. 5 to 9, the instant ergonomic hybrid transit access corridor 10 or 100 may be seen to include a plurality of x-axis integral, y-axis corridor segments. Therein, as may be noted, each corridor segment is characterized by a longitudinal or y-axis of indefinite length, however limited by x-axis intersections 12 more fully addressed below. It may, with reference to FIGS. 5 through 8, be appreciated that the instant ergonomic hybrid transit access corridor is characterized by a preferably centrally disposed bidirectional roadway consisting of lanes 14 and 15, each having a width preferably of 9 to 12 feet, which may be preferably separated by a roadway median 16 having a width of about 5 to about 20 feet. See embodiment of FIG. 7. Provided outwardly of lanes 14 and 15 are parallel parking segments 18, each having a width preferably of 8 to 9 feet.

Figure 10:
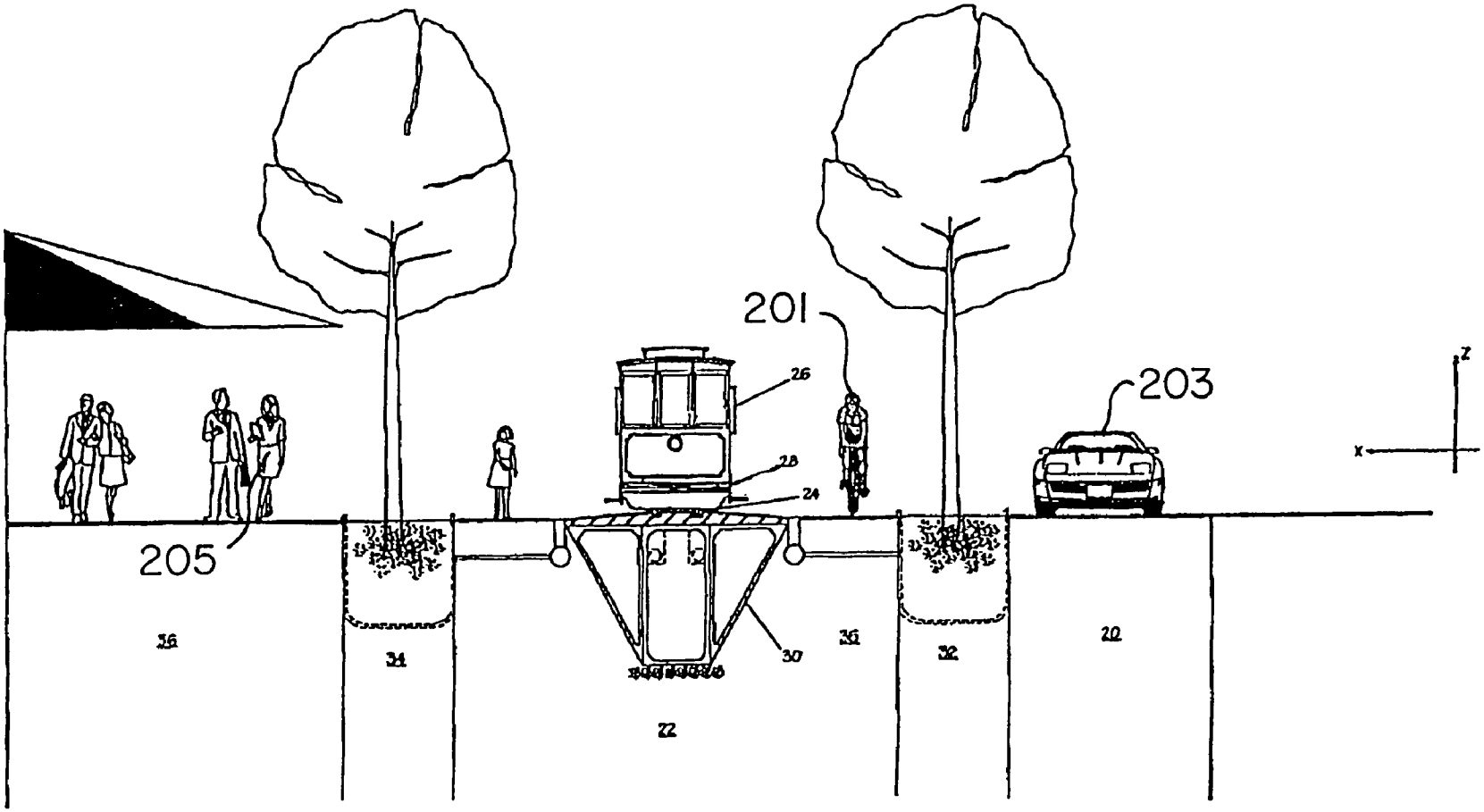
FIG. 10 is a view of low-profile, low speed transit vehicles usable within an ergonomic corridor.

In the elaborated embodiment of FIGS. 7 and 10, bicycle lane segments 19, each having a width preferably of 4 to 5 feet, are provided between roadway lanes 14*a*/15*a* and said parallel parking segments 18, 18*a* and 18*b* In the rudimentary embodiment of FIGS. 5-6, bicycle lane segments may be integrated or separately arranged from first greenscape segments 20 described below. In the alternative, the bicycle lane segments 19 can be widened to 7 feet to accommodate intermittent use of the bicycle lane by narrow gauge rail vehicles 26 as well as bicyclists 201 and that in such instances, the narrow gauge rail tracks 24 may have an x-axis with in the range of 30 to 40 inches and thereupon a moderate speed, e.g., 20 to 30 miles per hour, low profile, an electric, diesel hydraulic, steam, or other propulsion system, tram, trolley, train, or like transit vehicles 26 having a floor 28 (in the horizontal xy plane) situated as a level not exceeding about 20 inches above the plane of the bicycle lane 19.

Situated yet further symmetrically outwardly from parking segments 18 are said greenscape segments 20, having a width preferably of 3 to 6 feet or more when other segments or other corridor features are incorporated therein, which may include any of a variety of landscape and hardscape treatments and which can be used to laterally move from one corridor segment to another. Outwardly thereof are greenway transit segments 22, having a width preferably of 15 to 40 feet, which generally include narrow gauge rail tracks 24, that is, tracks having an x-axis width in a range of 24 to 30 inches and thereupon, a low speed, e.g., 5 to 10 miles per hour, low profile preferably electric, battery powered, tram, trolley, train or like transit vehicle 26 having a floor 28 (in the horizontal xy plane) situated at a level not exceeding about 20 inches above the plane of the greenway transit segments 22.

It is to be appreciated that each of the greenway transit segments 22 are multi-use in character, that is, functional for purposes of pedestrian and low speed bicycle or similar conveyance use both during periods when the small transit vehicles 26 are not present and, at lateral sides of the small-gauge rail tracks 24, when such transit vehicles 26 are upon the rail component of the greenway transit segment 22.

Optionally disposed beneath each greenway transit segment 22 (see FIGS. 6 and 7) is a multi-purpose underground utility conduit 30 as is taught in my U.S. Pat. No. 6,167,916 B1 (2001) 30 which serves as a means of unified utility delivery. As such, this multi-purpose underground utility conduit 30 includes subconduits for electricity; drinking water, re-use water, sewer lines and storm water drainage; natural or synthetic gas; telephone, cable television, fiber optics, and other communication and data transmission means; pneumatic tubes; security services; fire services; and low current magnetic induction tracks for vehicular propulsion. In addition, utility conduit 30 may be employed for storage, maintenance access, or transit power equipment for the greenway transit segments 22.

Figure 5:
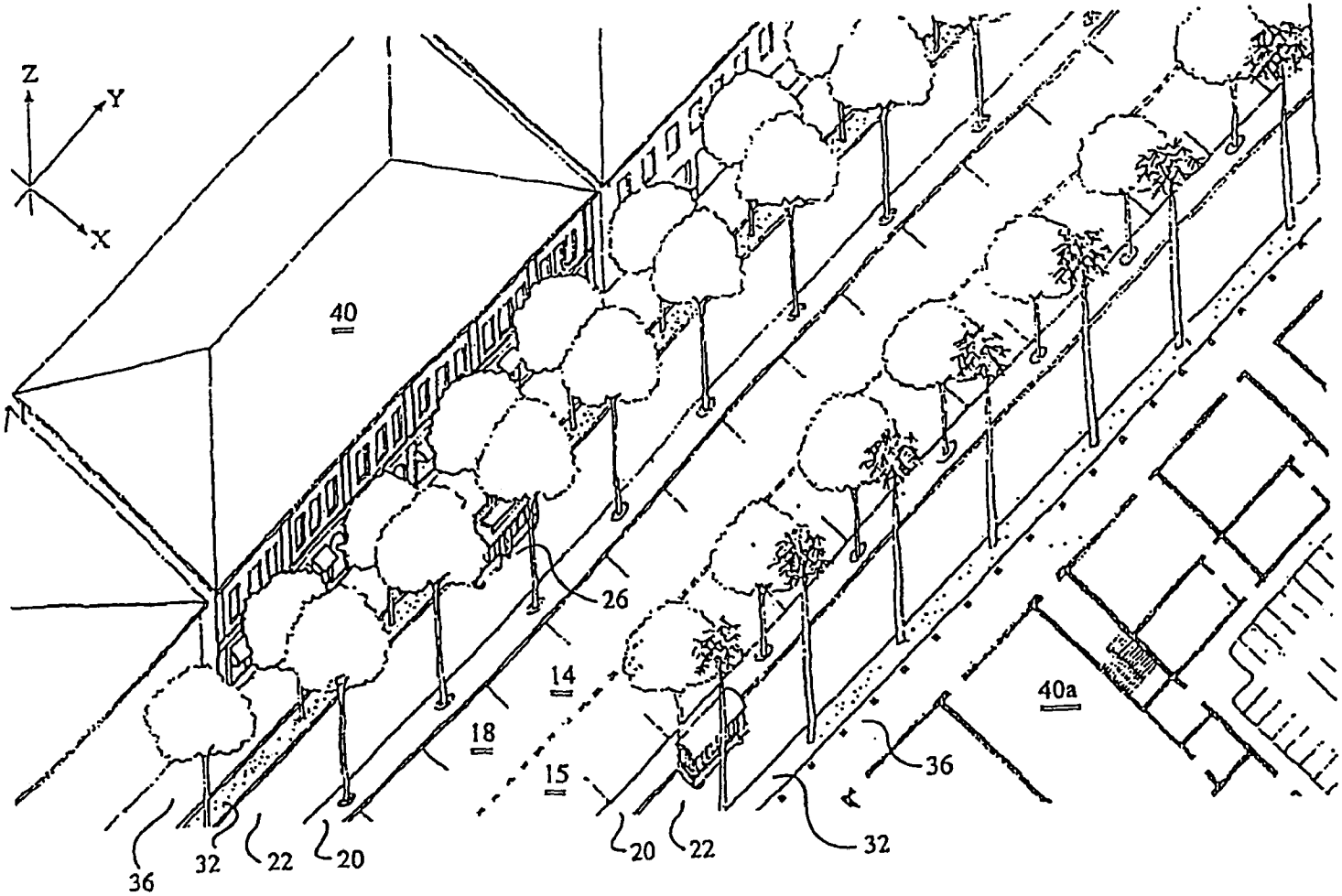
FIGS. 5-9 are views of an ergonomic hybrid transit access corridor usable in the city or town center.
Figure 6:
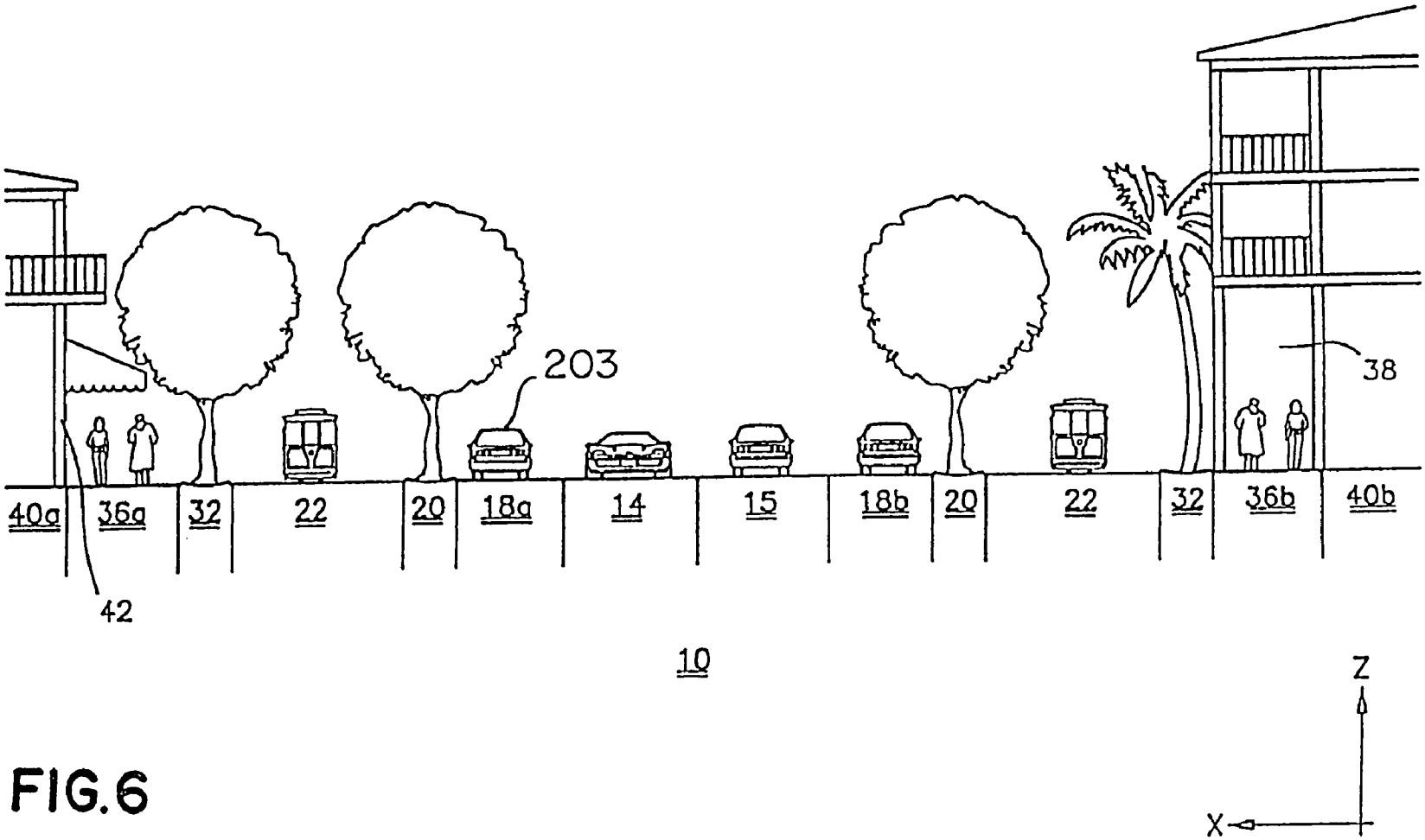
Figure 7:
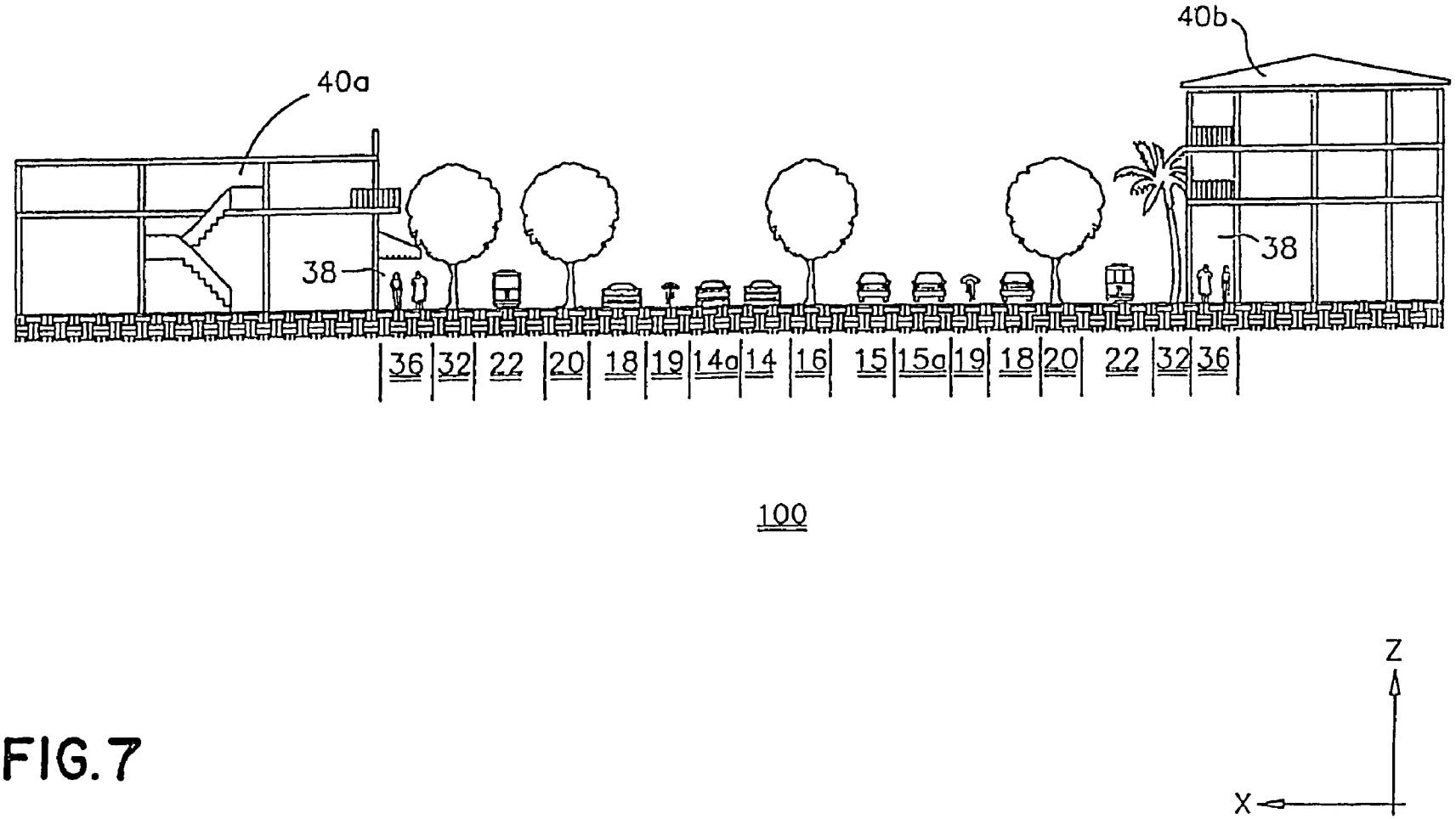

With further reference to FIGS. 5 and 6, there are located, further symmetrically outwardly from the greenway transit segment 22, second greenspace segments 32 which, as in the case with first greenspace segments 20, may include a variety of landscape and hardscape treatments and which can be used to laterally move from one corridor segment to another. Each of the greenspace segments 20 and 34 provide filtered sunlight and shade tree coverage for an optimum foliage spread of such segments and adjoined areas, as well as opportunities to install fountains and other artistic or architectural features to provide comfort and interest to the individuals traveling within the corridor segments.

Symmetrically outwardly beyond lateral segments 32 are pedestrian arcade-like segments 36, 36*a* and 36*b* having a width preferably in a range of 10 to 15 feet. The preferred xz plane cross-section of arcades 38 within segments 36 is shown in FIGS. 6 and 7. Therein it may be appreciated that, in a preferred embodiment, arcade 38 of segment 36, 36*a* or 36*b* is, in the xz plane, enclosed on two or three sides by architectural structures 40*a* and 40*b* which, at surface 42, provide for commercial stores and fronts thereof which may include therein a variety of y-axis uses and attractions.

The number and length of the store fronts or architectural details of surface 42 are designed to protect the pedestrian from the rain, wind, heat and cold, and to optimize pedestrian spacing and interest to urge the pedestrian to move continually forward along the y-axis toward a destination or transit linkage 12. A maximum distance for such pedestrian movements are defined in accordance with established psychological and medical criteria of how far a pedestrian can comfortably walk, in the given climate where the greenway transit system is located, before beginning to loose interest, perspire or tire, given the typical mental and physiological characteristics of individuals moving through the corridor segment.

Related to the time that it would typically take a consumer to walk along a pedestrian arcade segment 36 between destinations or transit use opportunities 12 is the periodicity of the schedule of community transit vehicles 26, the various rail services such as said link 243, bus transit systems, and other modal choices and a variety of end uses or refinements of the architectural design details. Accordingly, the schedule of the transit vehicles 26 as well as the land use itself and architectural design variations are a function of typical physiologic and psychological considerations.

Figure 8:
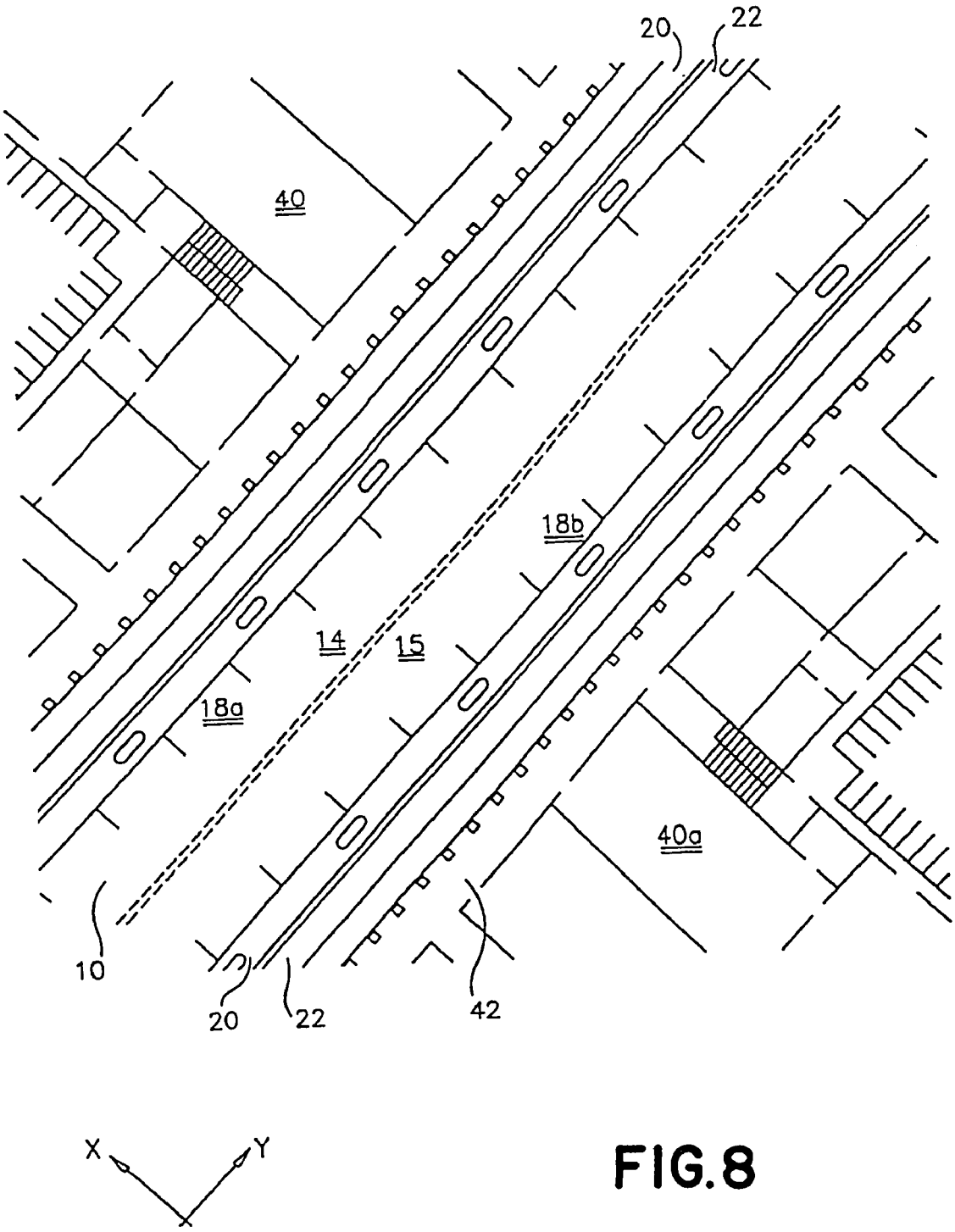

With reference to the top or xy plane view of FIG. 8, the lateral relationship between the entire above defined integral corridor segments 10 may be seen. Therein, as may be appreciated, are shown said greenway and enclosure ratios, which comprise two of the defining parameters of the present system. More particularly, the greenway ratio is defined as the ratio of the x-axis dimension of roadway 14/15, any roadway median, and parallel parking segments to the entire x-axis dimension of the corridors 10 or 100 (see FIG. 7). This ratio, in the instant system, exhibits dimensions that will not exceed fifty percent. The enclosure ratio is defined as the ratio of the z-axis of height of the architectural structures to the entire x-axis dimension of the corridor. This ratio in the instant system, at optimal dimensions, is at least thirty to about fifty percent. For example, if the width of each vehicular lane is 10 feet and the two lane roadway is therefore a width of 20 feet, the total x-axis dimension of the corridor will be at least 40 feet. With two 8-foot wide segments for parallel parking, the width of the corridor 10 or 100 would be 72 feet or greater. In such an example, the z-axis height of the architectural structures would range from at least 24 feet to about 36 feet.

A four lane roadway 14 and 15 (see FIG. 7) includes parallel parking segments 18 to produce a width of the corridor 10 or 100 of 112 feet or more with a 15 foot roadway median between each two lane roadway sections, the width of the corridor 10 or 100 would be 142 feet or more. The z-axis height of architectural structures 40 and 40*a* would range from about 37 feet to 56 feet in the first instance and about 47 feet to 71 feet in the second instance. Even at a maximum highway lane width of 12 feet, the overall width of the corridor would typically be at least two times the width of the roadway, the roadway median and the parallel parking segment.

Figure 9A:
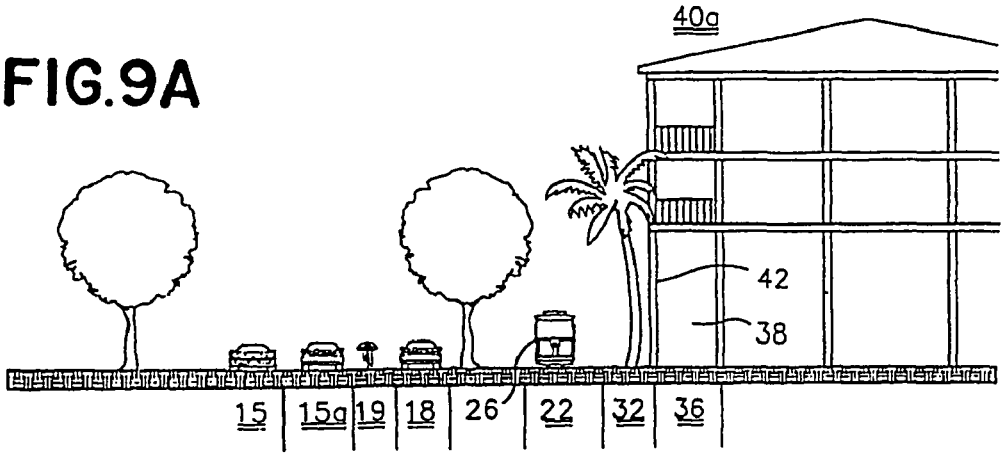
Figure 9B:
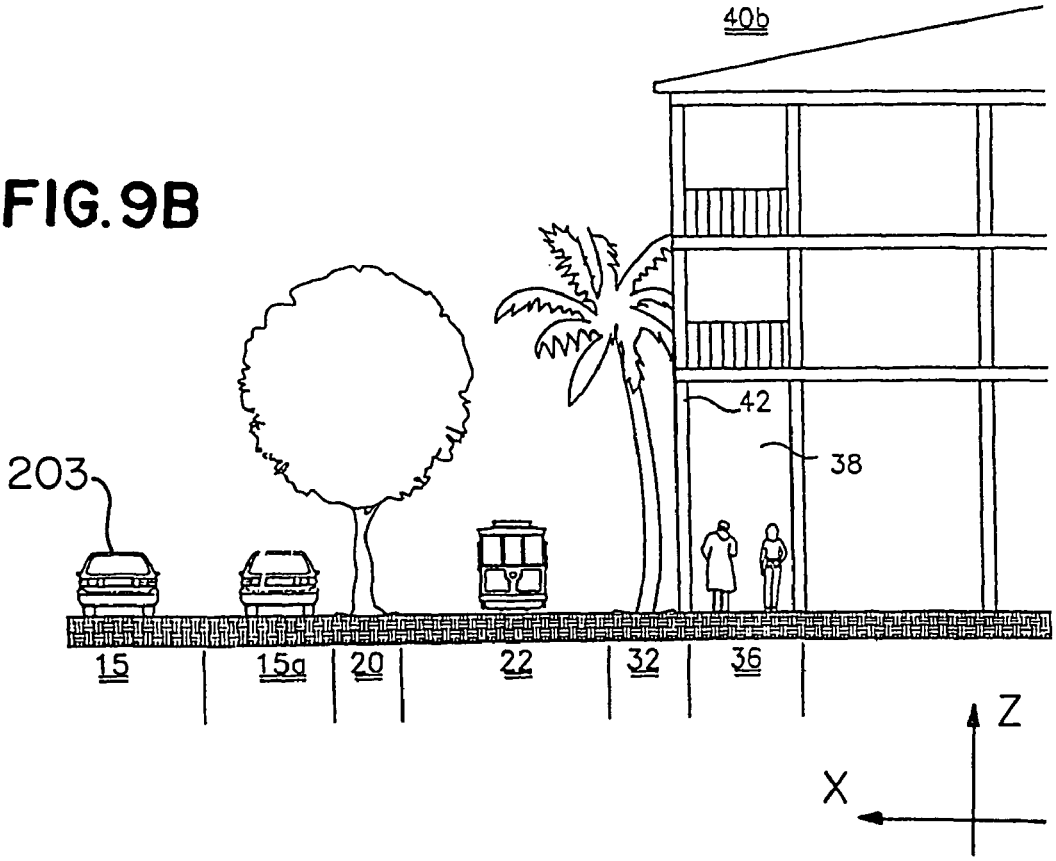

Per FIGS. 9A/9B, it is noted that arcade 38 may be defined through the use of arcades 38, balconies, porches, awnings, roof overhangs, zaquans, pedestrian vias, and other pedestrian and bicycle related shelters. That is, it is noted that vertical surface 42 defines an xz plane interface between the public right of way and private architectural structures such as structures 40*a* and 40*b*. These structures may be retrofitted to provide for arcades 38 or, alternatively, lobbies, courtyards, zaquans, or pedestrian vias.

In FIG. 9A, it is to be appreciated that within greenway transit segment 22 and greenspace segments 20/32 may be seen bicycle lanes 19 or walking trails. Also, all aspects of the corridor are provided with strategic architectural lighting for purposes of safety and aesthetics.

It is noted that said corridors 10 and 100 may comprise segments of larger linear, bidirectional, unidirectional, or loop-like planning configurations within said city or town center 260.

In the pedestrian corridors 262 (see FIGS. 4 and 13-14), the mixed-mode corridor 215, the ergonomic hybrid transit access corridor 10/100 (see FIGS. 6-7) for town and urban centers as taught by my U.S. Pat. No. 6,561,727 B1 (2003), and traffic calmed streets 209 (see FIG. 13-14), different senses operate at different distances, causing each sense to act in sequence to propel or redirect pedestrian movements in very predictable ways. What you see at a distance, you can hear and smell at closer quarters. What you see, hear and smell at close quarters, you can touch. What you see, hear, smell, and touch, you can taste, but only with the direct oral contact with the object or entity to be tasted.

This differential in the sensory reception distance forms the basis for the pedestrian propulsion system and the steering capacity of CIS urban forms (pedestrian-oriented corridors, plazas, traffic-calmed streets) in conjunction with large-scale pedestrian movements. With the use of a full range of human scales and the fractal qualities in the urban built and naturally-occurring structures and designs to excite visual interest at long, medium and short distances and the variety of needs that can be satisfied within mixed-use environments, pedestrian interest can be converted into a predictable and fully operational method of intermodal transport. (Salingaros, The Future of Cities [2006] at: http://www.math.utsa.edu/sphere/salingar/futurecities.html, A Theory of Architecture [2006] at: http://www.math.utsa.edu/~salingar/architecture.html, Principles of Urban Structure [2005] at: http://www.math.utsa.edu/sphere/salingar/urbanstructure.html, and *Pavements as Embodiments of Meaning for a Fractal Mind* [2000] at: http://www.nexusjournal.com/Miki-Sali-Yu.html.

In addition, the pedestrian corridors 208 and 262, the mixed-mode corridors 215, the ergonomic hybrid transit access corridors 10/100 particularly for town and urban centers as is taught in my U.S. Pat. No. 6,561,727 B1 (2003), outer plazas 215A, courtyards 264, traffic-calmed streets 209, and the adjacent built and landscape environment, provide comfortable places to sit during both the walk and ride phases of typical multimodal trips, i.e., provides comfortable and well-lighted places to sit, eat, socialize, protected from the natural elements. Doorways, windows, balconies and other entry features (see FIG. 11) provide frequent openings to the liner buildings 210/212 from plazas 266, courtyards, mixed-mode corridors 215, sidewalks and traffic-calmed streets 209. Zaquanes, pedestrian vias, and galleria or shopping mall corridors transect city blocks to create short pedestrian blocks (see: Jane Jacobs, The Death and Life of Great American Cities, 1961) and pedestrian access to shops, restaurants, hotel lobbies, and residences within the city block structures (see: Bernard Rudowsky, Streets are for People: A primer for Americans, 1969). Places to sit and short blocks help to form a healthy walking environment, without exhaustion.

Finally, the provision for ultra-low floor community transit vehicles 26 (see FIG. 10) allow for easy access from any sidewalk into a very human-scale vehicles (seven feet wide by nine feet tall) that functionally represent a slow moving, pedestrian-benign bench on wheels that move generally toward the many desired areas of the urban center. In such circumstances, the opportunity to sit, rest, ride and walk provides for larger pedestrian supportive areas and longer pedestrian-oriented multimodal trips.

Cars 203 remain a dominant method of transport, but they are parked in mixed-use pedestrian-oriented parking structures 200/202 surrounded by liner buildings 210 (see FIGS. 1-4) that help form this consistently reinforced pedestrian-oriented urban form and habitat in the public space between buildings. The pedestrian movements are much more visible and automobile and truck traffic is much less visible when compared to more typical urban environments elsewhere in the world. Air quality is improved and pedestrian safety is assured due to the very limited vehicular movements within these urban centers.

All multimodal trip needs are addressed so that a significant pedestrian-based model shifts to alternative modes of transport (bike racks, clean and safe public wash rooms, lockers, phone and internet services, food and drink outlets, way finding, mobility centers, abundant structured parking spaces, seamless transportation services and modal transfers for individuals and groups. As a result of the large-scale pedestrian movements, nearby mixed-use pedestrian-oriented structured parking and high quality public places for enhanced intermodal access, far larger numbers of the traveling public use public transport, automotive traffic congestion is reduced, and virtually all automotive trips can become multimodal trips.

Such community intermodal systems assume an intermodal community built environment that provides for all human needs, e.g., governmental, religious, commercial, health, education, entertainment, cultural, residential, and employment. Further, it assumes that the transportation systems that operate between and within the community intermodal system car-free centers (see: Carfree.com at: http://www.carfree.com/) or other pedestrian-oriented urban centers are safe, reliable, energy efficient, technologically advanced, and environmentally benign and that they enhance the region's global economic competitiveness, productivity, and quality of life. Finally, while specific single purpose buildings, especially those with more than eight floors, will exist within the pedestrian-oriented urban center, their first three floors or more will help to frame the high quality human habitat and provide for specific community needs within the CIS urban form, i.e., restaurants, retail goods and services, health related, social and governmental services.

Further, within a city or town center 260, the CIS components are themselves defined to specify that:

The corridor, courtyard and plaza components (see FIGS. 5-9, 12-15). These assume wide pedestrian corridors 262 (30 feet wide or more), wider mixed-mode corridors 215 (50 feet wide or more), courtyards 264 (60 feet square or so) and larger plazas 266 of varying shapes and sizes (100 feet square or more) act as gathering places for business, social and recreational functions, i.e., market in the morning, lunch in the afternoon, festivals at night; a partial tree canopy provide shade from the sun, open areas provide sunny places to sit or walk and water features provide for human needs, interest and comfort (drinking fountains, decorative fountains, water courses and water falls provide cool places to sit, visually interesting places to be and physically revitalizing environments) public art provides visual interest and, when properly constructed and designed, places for children to play; brick, stone or similar corridor and plaza surfaces provide surfaces sufficiently rough enough so as to be inconsistent with fast moving and dangerous automotive traffic and consistent with pedestrian walking needs; grass areas are large enough to sit, run and play and provide for water recharge and psychological linkages to our genetic past; continuous building faces protect the pedestrian from the sun, rain, wind, heat, and cold; elevated and covered entry structures associated with pedestrian-oriented mid-block crossings provide platforms for building and transit entries protected from any adjacent automotive traffic and the weather; attractive and useful landscape and hardscape provide color, shapes and smells responsive to human needs and wants; mixed-use buildings (See FIG. 11) open to the street at frequent intervals (doors, balconies, and windows at 30 foot or more frequent intervals); wider sidewalks or arcade-like segments 36 (15 feet wide or more), courtyards 264, plazas 266, adjacent traffic calmed streets 209, Ergonomic Hybrid Transit Access Corridor Particularly for Town and Urban Centers as is taught in my U.S. Pat. No. 6,561,727 B1 (2003) 245, mixed-mode corridors 215, and pedestrian vias, zaquanes, and galleria and shopping mall corridors (30 feet wide or more) provide a consistent, predictable and safe pedestrian course through and to the city center; narrowed automotive traffic lanes (10 feet wide or less) reduce average traffic speeds, wider shared-use bicycle and community transit traffic lanes traffic lanes (seven feet wide or so) improve car-bicycle accident safety, and limited on-street parking (configured as intermittent parallel parking on traffic-calmed streets alternating with movable or stationary sidewalk bulb-outs at each end of city blocks and at mid-block in coordination with identifiable pedestrian-oriented street crossings) provide with other traffic-calming techniques a safer mix of automotive, community transit, pedestrian and bicycle movements outward of the urban center; environmental street shutters that span the distance between buildings from opposite sides of pedestrian-oriented corridors above the third floor level are constructed of sail cloth, shade cloth or similar materials and move or rotate during the hours of the day and night to improve walking conditions by deflecting wind and rain from or to the public spaces below; calmed or no vehicular traffic for all or most of the day, week, and year to induce more pedestrian movements and reduce accidents between pedestrians and automotive traffics and resulting injuries; and, liner building faces that do not form a uniform plane reflecting the dimensional differences consistent with independently designed building face segments every 10 to 30 to 50 feet or so.

The structured parking components 200/202 assume that parking structures (see FIGS. 1-4 and 12-16) are located at the perimeter of the pedestrian-oriented downtown or urban center 260; one-directional vehicular movement 207 within the parking structure from access to exit points; parallel parking 207 along the parking structure outer edge; angle parking 226 around a central air/light atrium 228 that provides for landscape and drainage areas; longer and more narrow parking designs than are typical in urban setting today; mixed-use liner buildings 210/212 that surround the parking structure (10 to 30 to 50 feet in width and 60 feet or so in depth); self-powered, handicapped accessible elevator systems; and, elevated and below grade traffic aisles 268 between parking structures.

The community transit component (see FIGS. 9-10) assumes: small, fixed guideway community transit 26 (seven feet wide by nine feet tall) with an ultra-low vehicular floor (five inches from the road surface or flush with the sidewalks) to improve access at all places where the transit vehicle might stop; fixed rail and "on demand" rubber tire community transit service between downtown and urban center destinations beyond the length of a comfortable walk (beyond a one-quarter mile distance) and between modal access points, major community destinations, or other CIS sites; sound notification vehicle arrival systems built into the fabric of the community's music and sound systems so that music played on the community transit vehicles interacts with the music played at stationary locations where the community transit vehicle typically stops creating a stereophonic effect at such transit stops; and vehicles that quietly operate at low speed (five to ten miles per hour)

on mixed-modes corridors within downtowns and urban centers and at higher speeds (ten to twenty-five miles per hour) within wide (seven feet) shared-use bicycle and community transit traffic lanes on traffic-calmed streets outwardly for up to a five mile radius of the CIS.

The car-free city or town center 260 (see FIGS. 1, 4 and 13-16) assumes: the absence of a vehicular street grid at the downtown or urban center 260; access to direct freight deliveries at specific times of the day; convenient shared loading docks 230 for nearby freight movement at any time of day; nearby parking structures that keep car movements separate from the pedestrians in the carefree center (by use of liner buildings and elevated and below grade traffic aisles 268 between parking structures); pavement surfaces of decorative stone, brick, or similar surfaces that provide a pedestrian supportive pattern, natural drainage, a brick, cobblestone or other mixed-mode traffic-calmed streets 209 (see FIG. 16) that provides a rough ride to rubber tire vehicles and ADA acceptable walking conditions; extra efforts to make the building faces lively, unique, memorable, and characterized by features that provide a continuous protection to pedestrians from the natural elements, e.g., the sun, rain, wind, heat, and cold, and to make the plazas and courtyards areas comfortable as places to sit, rest, and socialize, i.e., market in the morning, lunches in the afternoon, festivals at night; smaller corridors that open to much larger plaza areas; significant community buildings 40 positioned on the perimeter of plazas 266 (places of worship, government, market areas, health care, education, and entertainment facilities, museums, major residential buildings or hotels and places of employment); underground utilities that can be installed where necessary in conduit beneath the sidewalks, pedestrian-oriented mixed-mode corridors 215, shared-use bicycle and community transit traffic lanes, and traffic-calmed streets 209: and, property values will substantially increase in the car-free areas (at least ten times the pre-CIS values) because people converse more frequently and with greater civility, freight moves efficiently to and from CIS destinations and beyond, the cultural, civic, and family life of the citizens improves and the local economy grows.

The limited access roadways 239 (see FIGS. 1 and 14) assume that: from existing or to be developed Interstate Highway System, toll roads and other major roadway intersections, access ramps are designed and built to give direct or nearly direct access to the parking structures; and, such direct access reduces congestion on the highway system by providing an alternative to sitting in your car on the congested Interstate Highway, toll road or major roadway segment, i.e., park and find things to do, places to eat, people to see or entertainment within the CIS; park and access other modes of transportation as a pedestrian 205 that are timely alternatives for local, regional or interregional destinations; park and visit friends, businesses at nearby CIS sites.

The elevated parking structure cross-over 204 (see FIGS. 1 and 4) and below grade parking structure traffic aisles 268 (see FIG. 15) and at-grade traffic-calmed access streets assumes: vehicular movement will generally occur from one parking structure 200 to the next 202 along elevated or below grade traffic aisles to minimize car/pedestrian conflicts in the car-free center; and, when the elevated traffic aisles are routinely positioned at the third level, mixed-use space can be constructed underneath it (spanning the distance between parking structures at the second level) to provide useful and interesting vistas, additional structural components of the CIS and shelter from the weather when pedestrians cross the street (at the ground floor level) beneath this mixed-use and vehicular aisle street-spanning structure.

Figure 13:
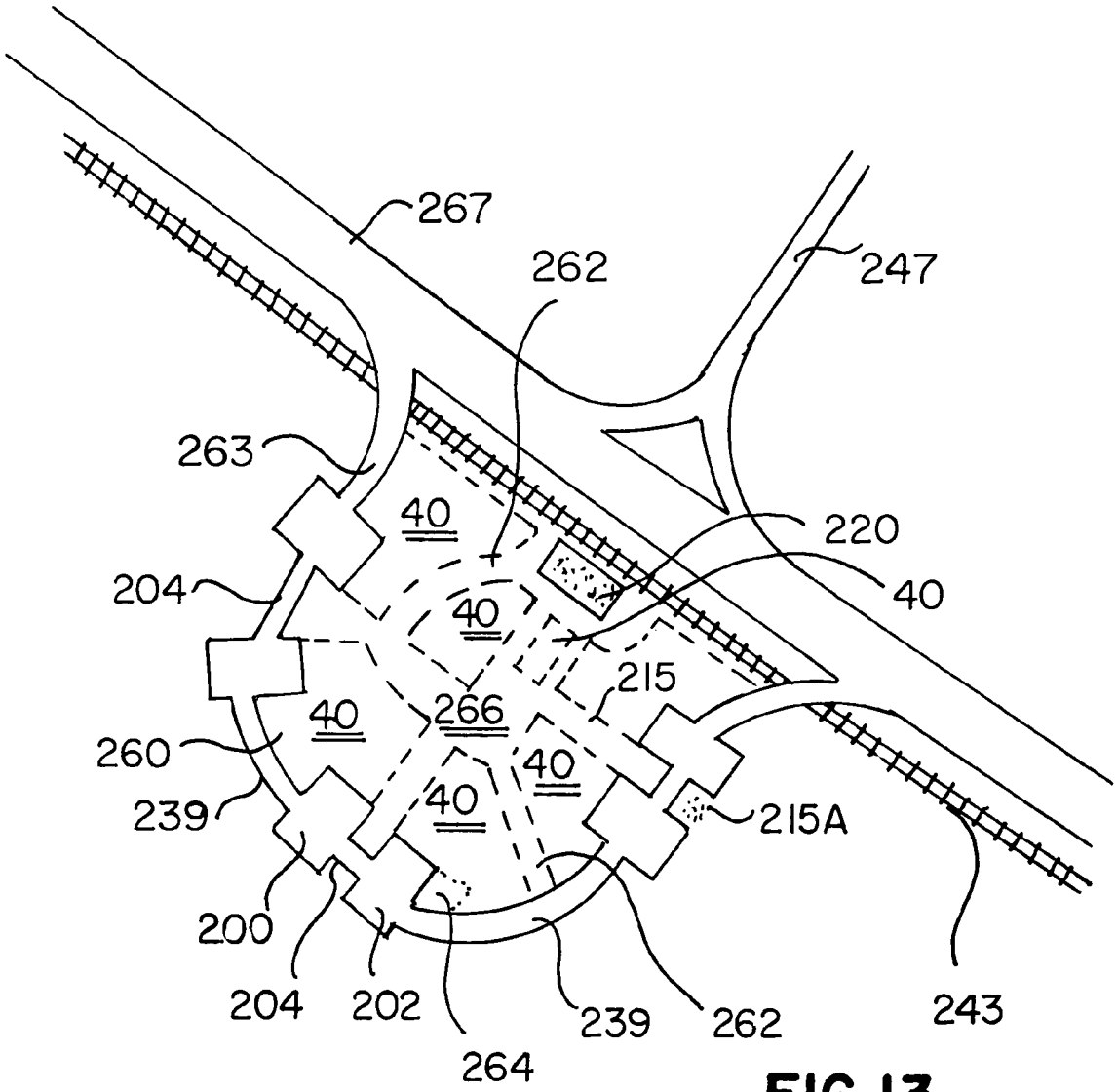
Figure 14:
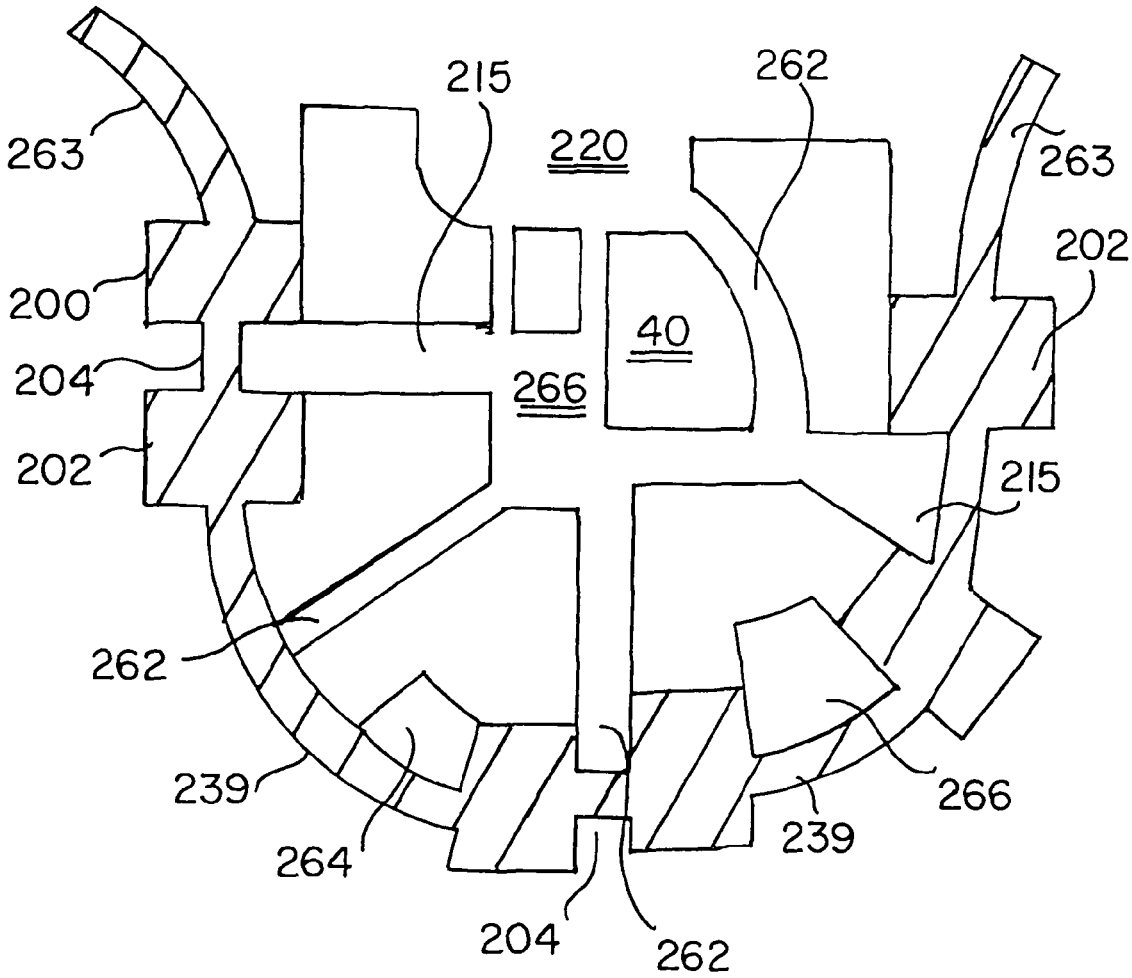
FIG. 14 is a figure ground depiction of the built urban environment (in gray), parking structure (in gray hatching) and pedestrian areas (in white) within an intermodal community city or town center.
Figure 15:
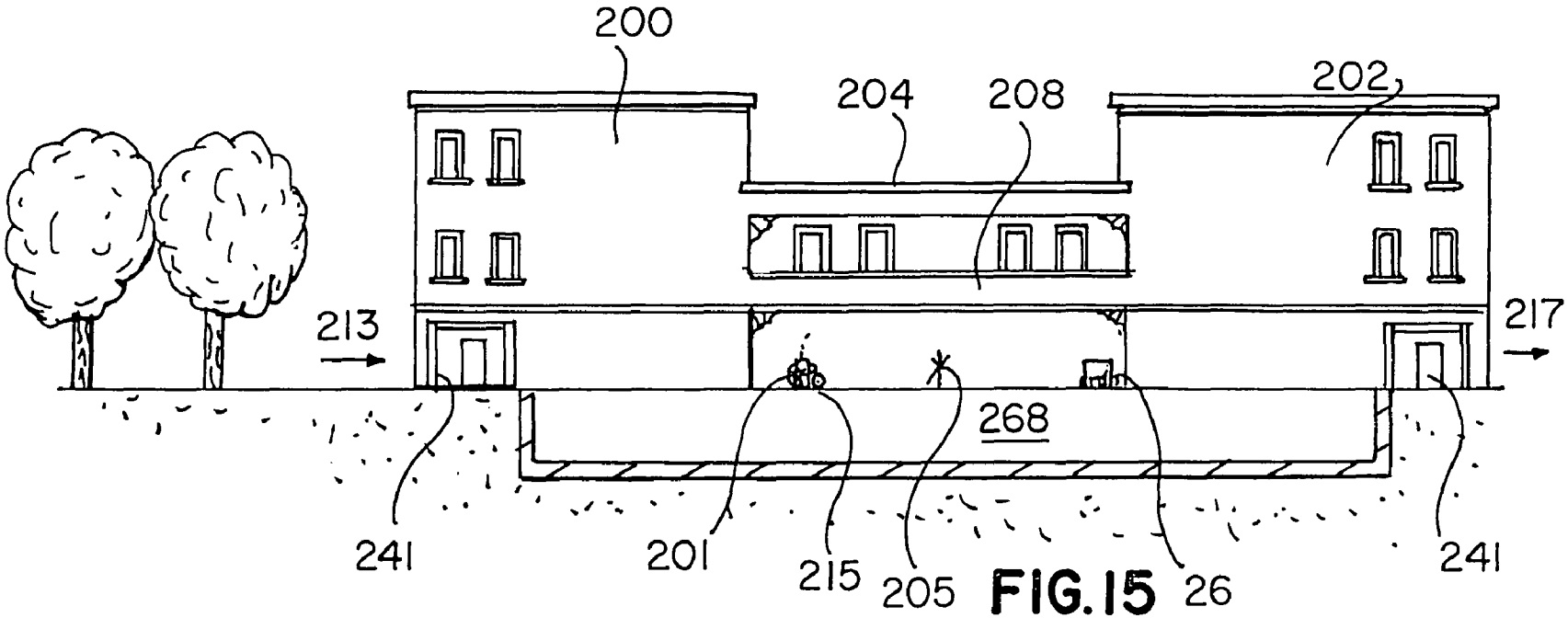
FIG. 15 is a view, related to FIG. 4, of an underground portion of a corridor between the two halves of a mixed-use pedestrian-oriented parking structure.
Figure 16:
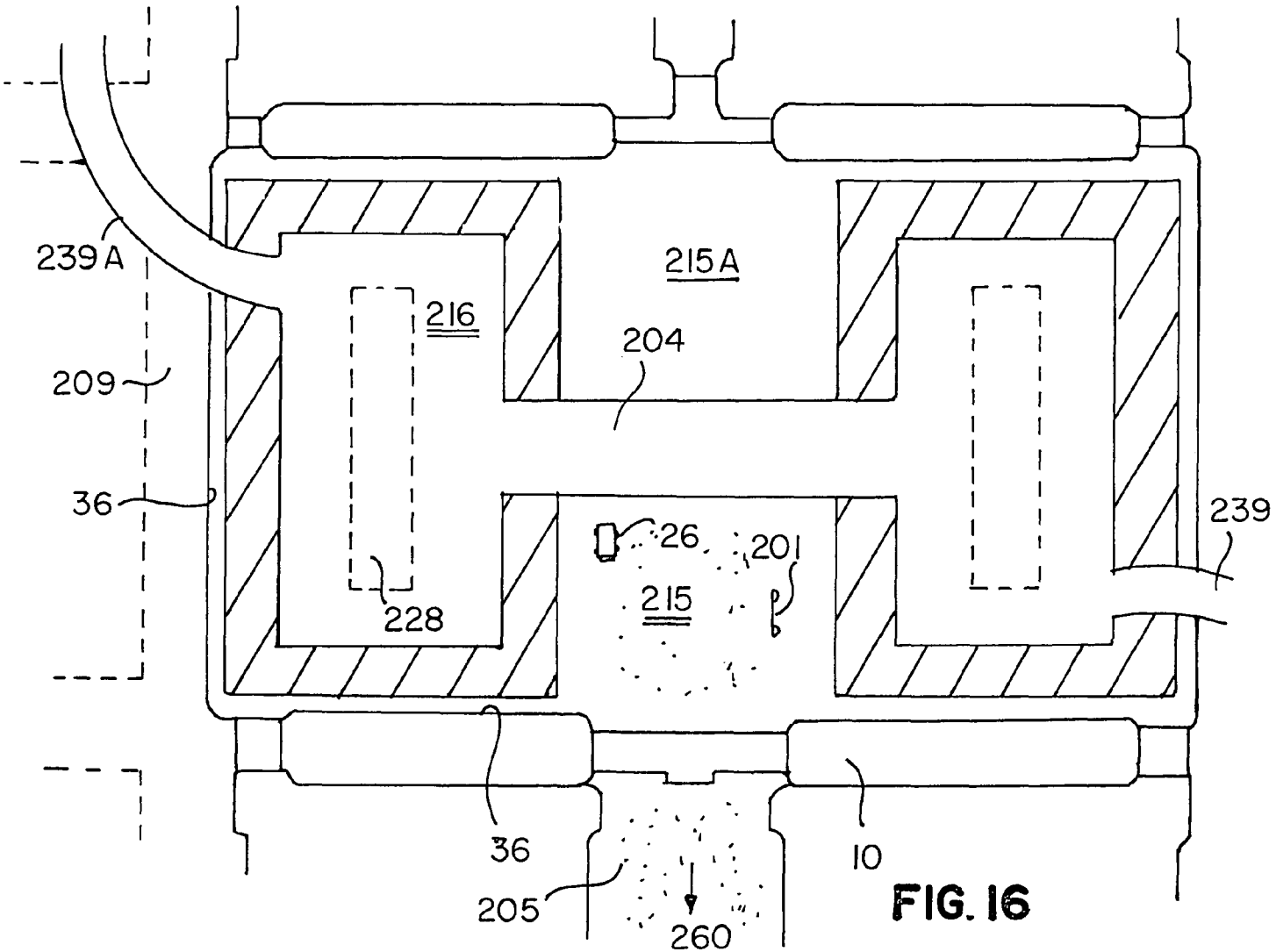
FIG. 16 is a view, related to FIG. 3 of highway entrances and exits to the parking structure via elevated highway ramps from limited access or other highways and related liner buildings, mixed-mode corridors, hybrid transit access corridors, traffic calmed streets, and sidewalks.

The CIS design as described differs from currently conceived transit oriented development (TOD) practices (see the materials, descriptions, and references found at: http://www.vtpi.org/tdm/tdm45.htm) due to following CIS attributes:

an abundance of structured parking immediately accessible from the interstate highway system 267), toll road or other major roadways;

liner buildings 210/212 that surround long and narrow parking structures that are positioned and constructed to shape the mixed-mode corridors, courtyards and plazas and to maximize pedestrian movements;

a car-free center that would diminish or eliminate the traditional street grid at the center where pedestrian-oriented corridors 262, courtyards 264 and plazas 266 connect destinations (see FIGS. 12-14);

traffic-calmed streets that access the parking structures and connect the CIS to other CIS, TOD, or significant community destinations (one to five miles outward from the urban center) on roadways constructed to provide for multimodal movements, specifically including a continuous seven foot wide or so shared-use lane for bicycle and narrow gauge rail or other community transit vehicles and TOD sites at one mile or so frequencies along the multimodal corridors; and community transit that moves to, from, and through the CIS and the intermodal community's city or town center 260 to nearby destinations.

Such CIS improvements (see FIGS. 1 and 12-13) provide for sufficient parking and density and intensity of use within a one-mile or so radius from the intermodal access points to assure the efficient and effective conversion of substantial automotive trips (30 percent or more) into multimodal trips where pedestrian, bicycle, transit, rail, waterborne and air transport movements complete the automotive trip segments. As many modern airport terminals provide easy access from automotive, transit or rail modes to the aircraft point of entry gates, such community-based, pedestrian-oriented intermodal systems will provide seamless intermodal transfers for multiple modes and increase rail, transit and intercity bus use, such as rail-to-parking-structure transfer 220, transfer 263 between interstate 267 and feeder highway 247.

Figure 17:
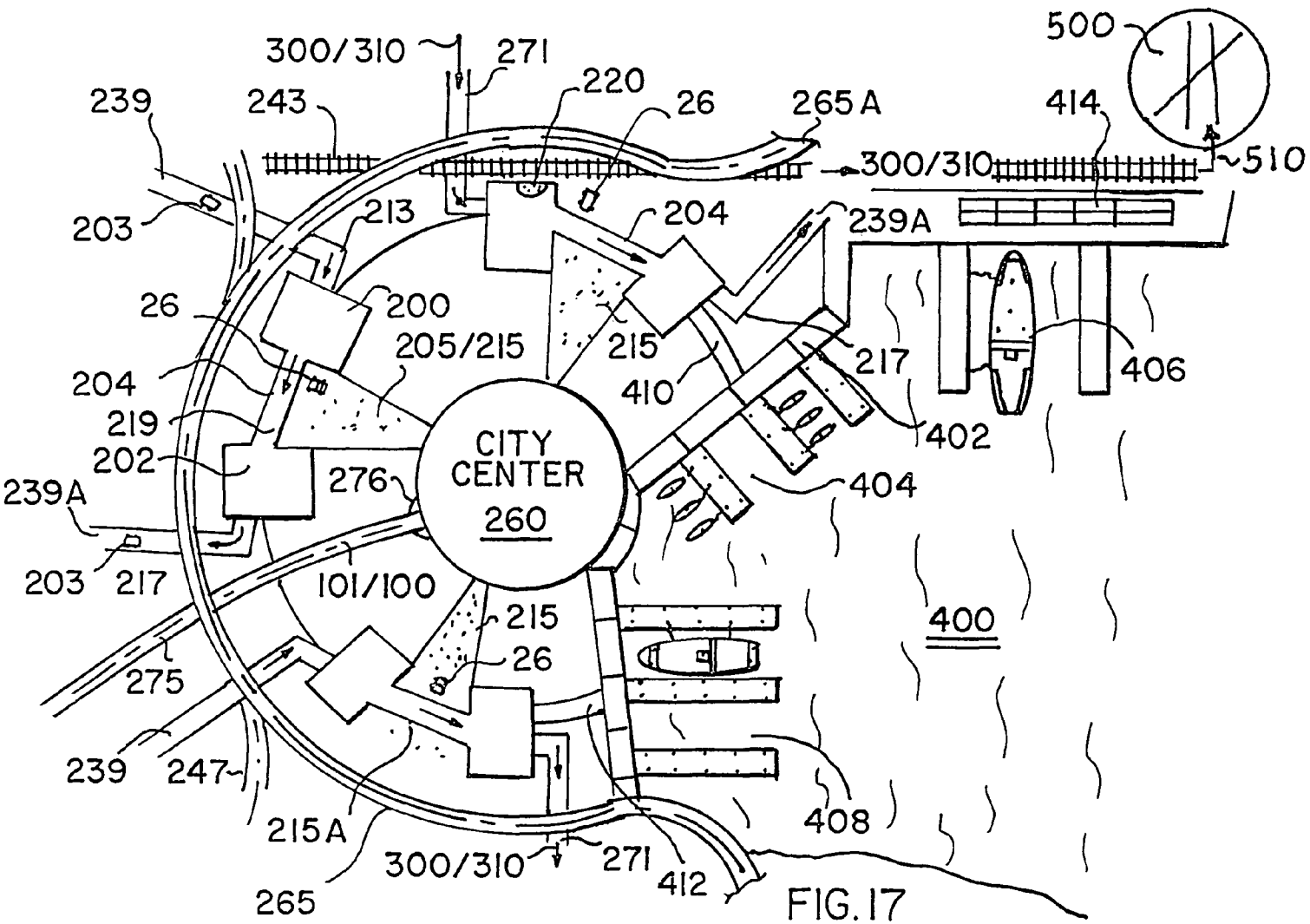
FIG. 17 is a view, similar to that of FIG. 1, however showing use of a beltway and associated structures of the Community Intermodal System that are not completely circumferential about the city center.

With regard to the view of FIG. 17, it is to be appreciated that said highway beltway 265 need not be entirely circumferential relative to city center 260 but, as shown in said figure, may surround less than 360 degrees relative to the city center if, particularly, the topology of a given community includes a harbor 400. Where such is the case, an approach road 265A may be employed in beltway 265 in the manner above described relative to FIGS. 1 and 12 regarding feeder highways 247. Further shown in FIG. 17 is harbor walkway, boardwalk or perimeter 402, a marina 404 for leisure craft, a container carrier 406 which may unload its containers at a container facility 414 which, therefrom, may be loaded upon container railway vehicles upon track 243. Also shown are cruise ship piers 408 as well as walkway 412 connecting the cruise ship pier to garage 202. Further shown is walkway 410 which connects marina 404 to parking structure 200. It is to be appreciated that the semi-circumferential embodiment of the invention shown in FIG. 17 is equally applicable where geographical features, other than a harbor, for example, a mountain, industrial area, or historic district, indicate use of a less than 360-degree expression of the present intermodal system.

FIG. 17 also notes that track 243 may service an airport 500 through a multi-modal transfer station 510.

At its core, the inventive intermodal and transit improvements aims to convert automotive travelers to pedestrian, bicycle, and transit users while encouraging private sector investments in community economic development, i.e., liner buildings related to the parking structures and other building projects within the CIS that provide places to live, work, pray, market and socialize. Mixed-use liner buildings would be built upon land acquired in bulk to construct parking structures, sidewalks, the pedestrian-oriented mixed-mode corridors and plazas, and the traffic calmed streets. Once such land has been made available for the intermodal improvements, e.g., parking structures, mixed-mode corridors, plazas, sidewalks and streets, the surplus lands can be sold to the appropriate bidder for liner buildings or other community building uses absent a private/public partnership to reserve such land for the property owners who pursue with the affected local governments a cooperative development strategy.

This transfer from automotive to alternative modes is in part accomplished by: connecting the long and narrow parking structures directly to the interstate off-ramp to improve car access to parking spaces; and, by keeping the walking distance as short as possible between the parked car and liner building destinations (from 5 to 40 feet) or between the car and the mixed-mode corridor 10/100 (from 70 to 100 feet) providing high quality pedestrian and transit access to multiple community destinations. (See FIGS. 12-14)

Other conditions that favor parking to pedestrian to transit intermodal transference are incorporated into: attractive and interesting architectural designs; safe, comfortable, useful, and interesting activities that can be undertaken along the mixed mode corridors, courtyards and plazas; and beneficial social interaction that occurs in the pedestrian-oriented and socially conducive public spaces between the car and the desired destinations.

There are multiple transportation related funding strategies that can be pursued to develop CIS improvements and multimodal transportation systems. Regardless of the statutory funding provisions that are used, it is clear that CIS related funding requests, when properly pursued, will be productive when the improvements are shown to serve a valid transportation purpose. While such improvements will simultaneously provide support for community and economic development goals and strategies, they will function as a highly successful intermodal system of transportation improvements.

Other economic impacts to be explored relate to the real estate value increases that can be expected when implementing pedestrian-oriented strategies. Throughout the world, downtown redevelopment successes have well established that the value return from thoughtful design and architectural variety when compared to similarly situated downtowns that allow lesser design standards to prevail. It would be safe to postulate that a ten fold property value change occurs between communities which insist upon the good pedestrian-oriented community designs compared to those that allow pedestrian-adverse good designs to prevail, given similar densities and modal access.

With such economic impacts derived from pedestrian-oriented designs, property owners are better positioned to partially self finance intermodal projects that include CIS improvements and TOD communities and will be stronger partners with government once planning and project commitments and development agreements have been secured. Further, should the sites where the CIS is developed be located within a community redevelopment district or similar governmental tax arrangements, then tax increment financing (TIF) and public bond financing, and other financial development plans add an additional level of governmental, property taxed based, funding options.

In the development of successful CIS improvements and TOD communities, care must be taken to organize the uses that are required for daily pedestrian needs. In the hallmark work of Lewis Mumfort, *The City in History: Its Origins, Its Transformations, and Its Prospects* (1961) (see: http://www.amazon.com/gp/reader/0156180359/ref=sib_dp_pt/104-8867215-2876748#reader-page), the essential city functions and building types are identified and placed in their historic context. Summarizing his conclusions, the buildings and uses that need to be established with any sustainable community, TOD or CIS can be identified. These functions and the buildings in which they are housed are:

- Governmental buildings providing public services to the citizens (courthouse, police and fire station, regulatory approvals, etc.).
- Religious buildings and faith-based or other family and child care services.
- Marketplaces (especially food, flowers and local crafts) in public plazas and courtyards, the buildings adjacent public plazas and courtyards, the pedestrian-oriented mixed-mode corridors and traffic-calmed streets.
- Hospitals, healthcare providers and therapeutic spa facilities.
- Education, recreation and parks facilities.
- Theatres and entertainment venues.
- Museums and cultural facilities.
- Residences.
- Places of work such as commercial offices, businesses and a variety of retail establishments that support urban life, i.e., restaurants, laundries and dry-cleaners, shoe repair shops, newspaper stands, drug stores, fruit and vegetable markets, bakeries, bicycle shops, candy stores, flower shops, tobacco shops, coffee and donut shops, copy services, pet stores, computer sales and services businesses, weight loss centers, exercise and athletic facilities, bait and tackle shops, cell phone stores, dentists, eye doctors, clothing stores, furniture outlets, glass wear and kitchen supply stores, hardware stores, barbers and hair salons, ice cream parlors, insurance and investment services offices, banks, accounting services offices, law firms, butchers, music stores, book stores, second-hand stores and pawn shops, realtors, storage facilities, toy stores, mobility centers, wine merchants.

Each and every use benefits economically from the large scale pedestrian activity adjacent its location along the mixed-mode corridors, plazas, courtyards, sidewalks, and traffic-calmed streets. The crowds, whether they are residents, customers, or visitors just passing through, represent a social life that is good for business and the social interchange of a cooperative working community.

While business owners and residents share the parking spaces that are located behind each liner building, the use thereof is preferably is staggered with different hours or shifts of work, residential occupancy and visitor, traveler, or customer parking needs. Density that adds value to land use and enhanced transit ridership is accomplished by both building heights (uniformly three to eight story buildings with occasional taller buildings as approved by City ordinance) and the reduced use of land for automobile transport.

Because the public spaces are well designed and represent public living areas, residential units can be reduced in size as more life can be enjoyed out of doors. Smaller units mean reduced housing costs even in high land value communities.

Fewer cars (the return of one and two car families and the emergence of no car families or individuals) mean more disposable income for housing, travel and cultural events.

Housing costs are further reduced because parking costs are shifted to federal and state transportation funds and parking spaces are shared with commercial/customer daytime users. When all of the development investment is spent on residential and commercial structures (not on the road access to parking improvements, the parking improvements or the land between buildings used for parking), housing costs are reduced and even high value properties become more affordable.

Simultaneously, community development can proceed without the use of local governmental general revenues because CIS funding is provided principally from federal and state transportation sources, from TIF funds, public bond financing, and from other governmental and private sources, augmented by HUD, SBA and other federal and state financing tools. In addition, because of the conversion from automobile to pedestrian, bicycle, and mass transit modalities, community health and vitality is substantially enhanced. Further, these community environments improve the urban lifestyle by incorporating educational resources, public art, the creative industries, commercial, retail, and entertainment districts within the clean-and-safe, 24-hour activity zones.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth herewith.

The invention claimed is:

1. A community intermodal transit system, comprising:

(a) a city or town center including at least one ergonomic hybrid corridor, said corridor comprising:

I. a vehicular roadway;

II. contiguously, symmetrically, outwardly of said roadway, respective parking segments;

III. contiguously, symmetrically, outwardly about said parking segments, respective first greenscape segments including selectable landscape and hardscape variables;

IV. contiguously, symmetrically, outwardly about said first greenscape segments, respective greenway transit segments for selectable use by pedestrians and vehicles operating at pedestrian-interactive speeds;

V. contiguously, symmetrically, outwardly from said transit segments, respective second greenscape segments including therein selectable landscape and hardscape variables;

VI. contiguously, symmetrically, outwardly beyond said second greenscape segments, respective pedestrian arcade segments that are at least partially covered, said segments having a width of between about 10 and about 15 feet, said segments defining a substantially continuous yz plane interface between linear pedestrian rights-of-way or easements, and substantially contiguous private commercial store frontage at ground level, thereby defining the outermost x-axis extent of said corridor;

VII. an enclosure ratio, of the z-axis height dimension of said continuous yz plane interface of said corridor, to an entire x-axis dimension of all segments of said corridor, that does not exceed a range of about thirty to about fifty percent at any point of said yz plane interface; and VIII. a greenway ratio of combined x-axis dimensions of said vehicular roadway and said parking segments, to said entire x-axis of said corridor that does not exceed about fifty percent;

(b) a plurality of low speed mixed-mode corridors extending substantially radially outwardly from said city center;

(c) a corresponding plurality of substantially circumferentially disposed parking structures located proximally to outer ends of said mixed-mode corridors; and (d) an outer transportation network including a plurality of modes of transportation, each mode including a transfer point to at least one of said parking structures.

2. The transit system as recited in claim 1, in which said transportation network comprises:

a high speed or other rail link.

3. The transit system as recited in claim 2, in which said transportation network further comprises:

highways.

4. The transportation system as recited in claim 3, in which said transportation network further comprises:

service roads to said city center.

5. The transit system as recited in claim 1, in which said transportation network further comprises:

highways.

6. The transit system as recited in claim 5, in which said transportation network comprises:

a high speed or other rail link.

7. The transit system as recited in claim 3, in which said highways include a limited access or other highway beltway circumferentially surrounding or adjacent said parking structures.

8. The transit system as recited in claim 5, in which said highways include at least a partial beltway circumferentially surrounding or adjacent parking structures.

9. The transit system as recited in claim 7, in which a transfer point of said high speed or other rail link exists within said beltway.

10. The transit system as recited in claim 8, in which a transfer point of said high speed rail or other link exists within said beltway.

11. The transit system as recited in claim 6, in which said transportation network further includes:

service roads to said city center.

12. The transit system as recited in claim 7, in which a service road begins substantially radially outwardly of said beltway and traverses it before reaching said city center.

13. The transit system as recited in claim 4, in which at least one of said parking structures comprises a mixed-use pedestrian-oriented structure comprising:

(a) at least two sequential multi-level parking units, each having one-directional parking access aisle;

(b) a liner building surrounding said parking units on at least one side of each of said sequential multi-level parking unit;

(c) a multi-use buffer corridor defining an interface between said parking units and said liner building, said liner building including at least one common wall with said buffer corridor, said wall including means for access to and from said buffer corridor; and (d) at least one exterior pedestrian-oriented corridor between at least one set of said sequential parking units.

14. The transit system as recited in claim 13, in which at least one of said low speed mixed-mode corridors comprises:

a walkway between said city center and said parking structures, said walkway including low speed, low profile public transit vehicles.

15. The transit system as recited in claim 14, comprising:

a radially outward part of said walkway extending at least to said pedestrian-oriented corridor between said sequential parking units.

16. The transit system as recited in claim 15, in which said walkway extends past said pedestrian-oriented corridor to form a plaza between said parking units of said parking structures.

17. The transit system as recited in claim 14, in which said city center includes a least one portion thereof having no vehicular street grid associated therewith.

18. The transit system as recited in claim 14, in which said city center includes a mixed-mode pedestrian corridor.

19. The transit system as recited in claim 17, in which said city center includes pedestrian-only areas that are partially covered to provide continuous protection of pedestrians from natural elements.

20. The transit system as recited in claim 4 further comprising:

a direct transportation link between at least one of said parking structures and an airport.

21. The transit system as recited in claim 4, further comprising:

a direct transportation link between at least one of said parking structures and a seaport.

22. The transit system as recited in claim 13, further comprising:

a direct transportation link between at least one of said parking structures and an airport.

23. The transit system as recited in claim 13, further comprising:

a direct transportation link between at least one of said parking structures and a seaport.

24. The transit system as recited in claim 1, in which one or more of said outer transportation system comprises:

an ergonomic hybrid corridor.

25. The transit system as recited in claim 21, in which said mixed-mode corridors, parking structures, and outer transportation network define a less-than-circumferential geometry proportioned to include said seaport in the intermodal transit system.

26. The transit system as recited in claim 22, in which said mixed-mode corridors, parking structures, and outer transportation network define a less-than-circumferential geometry proportioned to include said seaport in the intermodal transit system.

* * * * *